US006732553B2

(12) United States Patent
Rhode et al.

(10) Patent No.: US 6,732,553 B2
(45) Date of Patent: May 11, 2004

(54) EQUIPMENT WASHER

(75) Inventors: Randall J. Rhode, Westbank (CA); Margie A. Rhode, Westbank (CA)

(73) Assignee: Esporta Wash Systems, Inc., Kelowna ( * ) Notice: Subject to any disclaimer, the term of this patent is extended or adjusted under 35 U.S.C. 154(b) by 233 days.

(21) Appl. No.: 10/098,466

(22) Filed: Mar. 18, 2002

(65) Prior Publication Data

US 2002/0092329 A1 Jul. 18, 2002

Related U.S. Application Data

(63) Continuation-in-part of application No. 09/376,319, filed on Aug. 18, 1999, now Pat. No. 6,374,644.

(60) Provisional application No. 60/096,841, filed on Aug. 18, 1998.

(51) Int. Cl.[7] ..... D06F 23/02

(52) U.S. Cl. ..... 68/20; 68/24; 68/58; 68/142; 68/143

(58) Field of Search ..... 68/20, 24, 58, 68/142, 143

(56) References Cited

U.S. PATENT DOCUMENTS

| | | | | | |
|---|---|---|---|---|---|
| 33,661 | A | | 11/1861 | Parkhurst | |
| 119,859 | A | | 10/1871 | Lee | |
| 135,805 | A | | 2/1873 | Henson | |
| 182,209 | A | * | 9/1876 | Mary | 68/142 |
| 486,763 | A | | 11/1892 | Campbell | |
| 619,910 | A | | 2/1899 | Stone | |
| 620,470 | A | * | 2/1899 | Mallinson | 68/143 |
| 659,921 | A | | 10/1900 | Hartsough | |
| 687,374 | A | * | 11/1901 | Hamer | 68/152 |
| 687,375 | A | * | 11/1901 | Hamer | 417/529 |
| 687,742 | A | * | 12/1901 | Gilmore | 68/142 |
| 707,409 | A | * | 8/1902 | Guitar | 68/143 |
| 1,358,601 | A | | 11/1920 | Witthuhn | |
| 1,660,808 | A | * | 2/1928 | Olney | 68/143 |
| 1,665,118 | A | * | 4/1928 | Thompson et al. | 68/143 |
| 1,781,217 | A | * | 11/1930 | Clover | 68/143 |
| 1,849,674 | A | * | 8/1932 | Duffy | 68/152 |
| 1,869,674 | A | * | 8/1932 | Duffy | 68/152 |
| 1,937,276 | A | * | 11/1933 | Jenks | 68/19.2 |
| 2,015,119 | A | | 9/1935 | McEwen | |
| 2,098,890 | A | * | 11/1937 | Schmitz, Jr. | 68/152 |
| 2,264,846 | A | * | 12/1941 | Huebsch | 68/17 R |
| 2,426,843 | A | | 9/1947 | Phair | |
| 2,431,418 | A | * | 11/1947 | Olen | 68/152 |
| 2,875,602 | A | * | 3/1959 | Galinski | 68/19.2 |
| 2,887,354 | A | * | 5/1959 | Lichtenstein et al. | 504/289 |
| 3,036,616 | A | * | 5/1962 | Allen | 383/39 |
| 3,435,835 | A | * | 4/1969 | Hobbs | 134/108 |
| 3,724,095 | A | | 4/1973 | Laue et al. | 34/139 |
| 3,744,402 | A | * | 7/1973 | Piegza et al. | 99/360 |
| 3,840,998 | A | * | 10/1974 | Marcussen | 34/128 |
| 3,853,622 | A | | 12/1974 | Rutten | |
| 4,091,548 | A | | 5/1978 | Daily | 34/133 |
| 4,109,397 | A | | 8/1978 | Daily | 34/239 |
| 4,370,992 | A | * | 2/1983 | Choudhury et al. | 134/100.1 |
| 4,617,743 | A | | 10/1986 | Barnard | 34/109 |
| 4,677,760 | A | | 7/1987 | St. Louis | 34/90 |

(List continued on next page.)

FOREIGN PATENT DOCUMENTS

| | | | |
|---|---|---|---|
| AU | 125572 | * | 9/1947 |
| SU | 549537 | * | 4/1977 |

*Primary Examiner*—Frankie L. Stinson
(74) *Attorney, Agent, or Firm*—Antony C. Edwards

(57) ABSTRACT

A washing machine includes a frame, a tub rigidly mounted to the frame, and at least one basket rotatably mounted inside the tub. The basket is an open-lattice sided container having a releasably closable lid. The basket is adapted for holding articles of apparel or other flexible articles substantially stationary relative to the basket as the basket is rotated relative to the tub. A water supply cooperates with the tub for washing and rinsing the articles held in the basket.

3 Claims, 31 Drawing Sheets

U.S. PATENT DOCUMENTS 4,703,565 A * 11/1987 Kantor ..... 34/261
5,080,312 A 1/1992 Ebey
5,220,734 A 6/1993 Carver
5,276,979 A 1/1994 Gordon, Sr.
5,299,587 A * 4/1994 Randall et al. ..... 134/111
5,398,428 A 3/1995 Wallace
5,519,949 A 5/1996 Gibson, Jr.
5,546,771 A * 8/1996 Bonar ..... 68/4
5,562,114 A 10/1996 St. Martin
5,743,025 A * 4/1998 Jordan, Jr. ..... 34/600
5,803,605 A * 9/1998 Masi ..... 383/38
5,907,961 A * 6/1999 Lee et al. ..... 68/140

* cited by examiner

EQUIPMENT WASHER

CROSS REFERENCE TO RELATED APPLICATION

This application is a Continuation-in-Part of U.S. patent application Ser. No. 09/376,319 filed Aug. 18, 1999, now U.S. Pat. No. 6,374,644 which claims priority from U.S. Provisional Patent Application No. 60/096,841 filed Aug. 18, 1998 entitled Sports Equipment Washer.

FIELD OF THE INVENTION

This invention relates to the field of devices for washing clothing or other flexible articles.

BACKGROUND OF THE INVENTION

Anyone who has played sports, or lived with a person who plays sports such as football or hockey or like sports requiring the wearing of protective armour such as helmets, boots, shoulder pads and the like, is aware that, although the manufacturer of the equipment likely allows for the washing of such equipment, such equipment is only infrequently washed by hand due to the bulky nature of the pieces of equipment and hard armour which make using a conventional residential washing machine or laundromat washing machine tedious, difficult and in some cases impossible. Further, in some instances sports apparel, such as ballerina's shoes, cannot be washed in conventional washing machines due to the nature of the apparel, for example, due to fragility of the material, or otherwise. Other flexible articles such as harnesses for lifting bed-ridden invalids often become soiled and require washing. Due to their construction washing of such harnesses has in the past been done by hand.

Certainly, in the prior art, conventional washing machines, for example of the variety which have a wash tub with a generally centrally disposed vertically upright washing agitator, restrict the number or size of articles of sports equipment that may be washed at one time. Consequently, numerous washing cycles are required to merely wash one complete outfit of sports equipment, and larger items may not fit into the washing machine at all. Further, it has been found that the movement of the agitator causes damage to the equipment.

It is therefore an object of the present invention to provide a device and in a preferred embodiment a cooperating bag, mesh container, or the like, so that flexible apparel or most if not all of a sports equipment outfit may be placed into an easily accessible washing cage or basket, wherein the cage or basket is selectively closable and, once closed, agitatable within a water tight enclosure such as a washing machine tub. Specifically, it is an object to hold the article to be washed fixed in the cage or basket, and to move the entire cage or basket relative to the enclosure to obtain the flushing of water in and around the articles.

In the prior art, Applicant is aware of various patents relating to the placement of cages or baskets within clothes dryers. In particular, U.S. Pat. No. 4,091,548 and 4,109,397 which issued to Daily for a Door Mounted Stationary Drying Rack and a Rotatable, Non-Tumbling Drying Rack Respectively disclose how to place articles into conventional tumbling dryers so as to prevent articles placed into the dryer being, in the first instance, rotated, and in the second instance tumbled. In the first Daily teaches a drying rack that maintains article stationary within an open lattice-work basket while the clothes dryer executes its tumble dry cycle. The basket is maintained stationary relative to the rotating drum of the dryer by being mounted to the dryer door. In the second instance, the basket is mounted to the drum of the dryer and provided with a cover which may be closed into the basket so as to apply pressure to articles in the basket so as to hold the articles stationary within the basket as the basket is rotated in the dryer drum.

Applicant is also aware of U.S. Pat. No. 5,743,025 which issued to Jordon, Jr. for a Dryer Basket for Sneakers Insertable into a Clothes Dryer. As with the Daily '397 patent, Jordan, Jr. discloses the use of an open lattice-work basket mountable into the drum of a clothes dryer. A plurality of such baskets are mounted within the drum in radially spaced relation, removably secured within the drum adjacent to the drum tumbler veins. The baskets are adapted for holding sneakers within the dryer drum, for tumbling of the sneakers without the noise that would otherwise be associated with the loose tumbling of sneakers in the dryer drum. Ballast is provided for placement into the baskets, the placement of the ballast serving to maintain a balance load within the dryer.

Applicant is further aware of U.S. Pat. No. 3,724,095 which issued to Laue et al for a Delicate Goods Tray which, similar to the Daily '548 patent teaches an open lattice container for holding articles stationary during turning of a dryer drum. Similarly, U.S. Pat. No. 4,617,743 which issued to Barnard for a Dryer Insert, Holder, Container and U.S. Pat. No. 5,276,979 which issued to Gordon, Sr. for a Shoe Drying Support Apparatus, both teach mounting an open lattice container into the drum of a dryer, the former for holding hosiery, tennis shoes and the like, and the latter two position canvas-type shoes and the like within the dryer drum. Both devices employ a telescoping rod to secure the container within the drum for rotation therewith.

U.S. Pat. No. 5,546,771 which issued to Bonar for a Combination Clothes and Dish Washer & Dryer discloses converting a clothes washer to a dish washer by removing the clothes washer agitator and installing a basket for holding dishes. A hot air dryer structure is mounted into the washer to dry the dishes when the clothes washer is used as a dish washer. In particular, an air dryer blower is provided for circulating hot air through the inside of the washing machine cabinet.

SUMMARY OF THE INVENTION

In summary, the washing machine of the present invention includes a frame, a tub rigidly mounted to the frame, and at least one basket rotatably mounted inside the tub. The basket is an open-lattice sided container having a releasably closable lid. The basket is adapted for holding articles of apparel or other flexible articles substantially stationary relative to the basket as the basket is rotated relative to the tub. A water supply cooperates with the tub for washing and rinsing the articles held in the basket.

In one preferred embodiment, a mesh bag is provided for holding the articles. The mesh bag may be removably securable within the basket and may be compartmentalized for simultaneously holding various articles in spaced apart array. The mesh bag may include a main compartment of a generally rectangular parallelepiped shape mountable into the basket so as to lay the mesh bag flat.

The basket may be sized so as to fit therein the mesh bag folded in half and laid flat. A rigid, open-lattice spacer may be provided for placing sandwiched between folded-over halves of the mesh bags.

In a further aspect, the present invention may be described as washing and drying device for flexible articles. The device includes a watertight housing, a rotatable frame rotatably mounted within the housing for rotation of the frame about an axis of rotation, a plurality of water porous baskets mounted to the frame. Each basket has a releasably securable lid and means for securing the flexible articles in the basket so as to releasably hold the articles substantially stationary relative to the basket as the frame is rotated relative to the housing. A selectively controllable drive rotates the frame relative to the housing. A wash water supply and drain cooperate with the housing for, respectively, pressurized supply of wash water into contact with the baskets, and for draining the wash water. A forced air dryer may be mounted to the housing for drying the articles in the baskets as the baskets are rotated on the frame relative to the housing.

Advantageously, the forced air dryer has an inlet mounted to the housing at a first position on the housing, and an exhaust outlet mounted to the housing at a second position on the housing. A second position is radially spaced from the first position about the axis of rotation so that, when rotated about the axis of rotation in a first direction, a basket rotates a first distance from the inlet to the exhaust outlet. When rotated about the axis of rotation in a second direction opposite to the first direction about the axis of rotation, the basket rotates a second distance from the inlet to the exhaust outlet. When the first and second distances are not equal, during a drying cycle the frame and the baskets are rotated so as to pass from the inlet to the exhaust outlet along which ever distance is the longer distance of either the first or second distances. This provides a maximum dwell time in the housing of an airstream forced into the housing through the inlet into drying contact with the articles in the baskets before the airstream exits the housing through the exhaust outlet.

The wash water supply may comprise at least one spray nozzle for injecting wash water into the housing in a spray directed to include a portion of the spray perpendicular to the axis of rotation. The spray nozzles may include a pair of banks of spray nozzles radially spaced apart in the housing about the axis of rotation.

In a further aspect of the present invention each basket is drawer-mounted into the frame for sliding removal or exposure of each basket from the frame. A door in the housing provides access to the frame. The lid on each basket is operable once the basket is slid from inside the frame through the door so as to facilitate loading and unloading the articles from the basket. The frame may include slides so that each basket may be slid on the slides generally parallel to the axis of rotation through the door. Further, the slides may be telescopic slides mounted in sliding cooperation to the frame and to each basket. The frame may be rotated so as to sequentially position each basket adjacent the door for sequential access to the plurality of baskets.

In yet a further aspect, the housing is a cylindrical drum radially symmetric about the axis of rotation and the frame is a cage symmetrically shaped relative to the axis of rotation, wherein the plurality of water porous baskets are mounted in radially spaced array on the cage, radially spaced about the axis of rotation. The baskets are slidably mounted on the cage for sliding of each basket from the housing when the cage is stationary before engaging a washing or drying cycle of the device.

Advantageously, the baskets are open-lattice rigid baskets and further comprise an air and fluid porous spacer for placing between the articles when held within each basket for facilitating fluid and air flow between the articles. Each basket may be generally rectangular, one side of the basket conformally curved to correspond in shape to a cylindrical inner surface of the housing. The cage may be a cylindrical frame-work of rigid hoops held rigidly apart and rigidly perpendicular to a center axis member by radially spaced apart spokes, the center axis member co-axial with the axis of rotation. The hoops are sized for snug fitment within the inner surface of the housing. The inner surface of the housing may be a rigid perforated liner spaced radially inwardly from an exterior cylindrical wall of the housing. Each the basket may further comprise a removable compartmentalized porous bag releasably mountable into each the basket. The bag may be sized to fold over the spacer and when so folded to snugly fit into the basket. The compartments within the bag are porous and sized to firmly hold specific articles within the bag in an optimized spatial relationship relative to the frame and the housing when the bag is releasably mounted in a basket for optimized washing penetration of the wash water into and through the articles and for optimized penetration of drying air into or through the articles. The articles may be held in the bag in a substantially laid-flat orientation relative to an inner side of the basket, the inner side radially innermost in relation to the axis of rotation.

In a further alternative aspect the washer may be either top loading or side loading containing a cylindrically shaped basket or drum which is open at the proximal end and closed at the distal end. An elongate supporting sleeve, passing axially through the drum along its axis of rotation and mounted to the drum at its closed distal end, permits the drum to be mounted over a drive axle for cooperative rotation therewith.

The interior of the drum may be compartmentalized so as to adjustably provide for larger or smaller items to be washed by placing one or more removable baffles or other compartmentalizing walls radially between the supporting sleeve and the interior surface of the drum. The baffles may extend parallel to the sleeve, from the closed distal end of the drum to the open proximal end. In this embodiment of the present invention reference to basket or drum is used interchangeably to include water porous cylinders mountable in a washing machine for rotation about a co-axial axis of symmetry and rotation of the cylinder.

In this embodiment the cylinders have removable compartmentalizing walls forming first compartments within the container. A second container or containers, referred to herein as equipment containers or mesh bags, are mountable or mounted in the first compartments. The second containers themselves have second compartments for holding the items to be washed substantially stationary relative to the cylinder and separated to avoid the items balling, knotting or packing against the cylinder walls during centrifugal spin drying.

Radially spaced about the interior surface of both the drum and the exterior surface of the supporting sleeve are elongated baffle connectors or mounting strips. The connectors may be tee-shaped in cross section so as to have the cross flange spaced outwardly from the adjacent surfaces of the drum and supporting sleeve respectively. The connectors are also mounted parallel to the supporting sleeve and may extend from the closed distal end of the drum to a position adjacent the open proximal end of the drum.

An open channel member formed on a pair of opposing edges of each baffle enables the baffle to slidably engage and be releasably retained in position by the connectors on the supporting sleeve and the inside face of the drum so as to form a radially spaced array of baffles extending from the sleeve to the drum wall, radially adjustably spaced about the axis of rotation of the drum.

DETAILED DESCRIPTION OF EMBODIMENTS OF THE INVENTION

Figure 1:
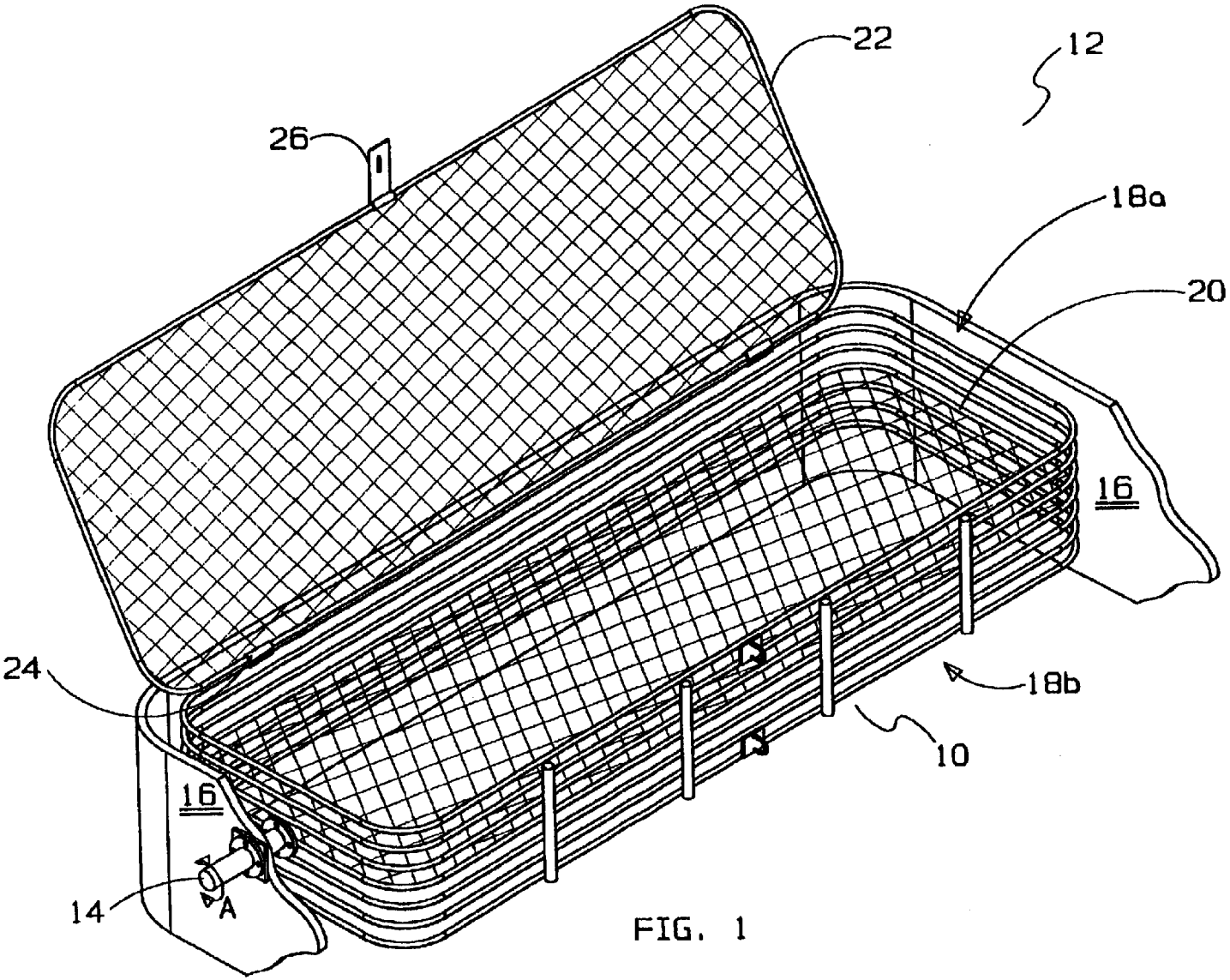
FIG. 1 is, in perspective cut away view, the sports equipment washer of the present invention.
Figure 5:
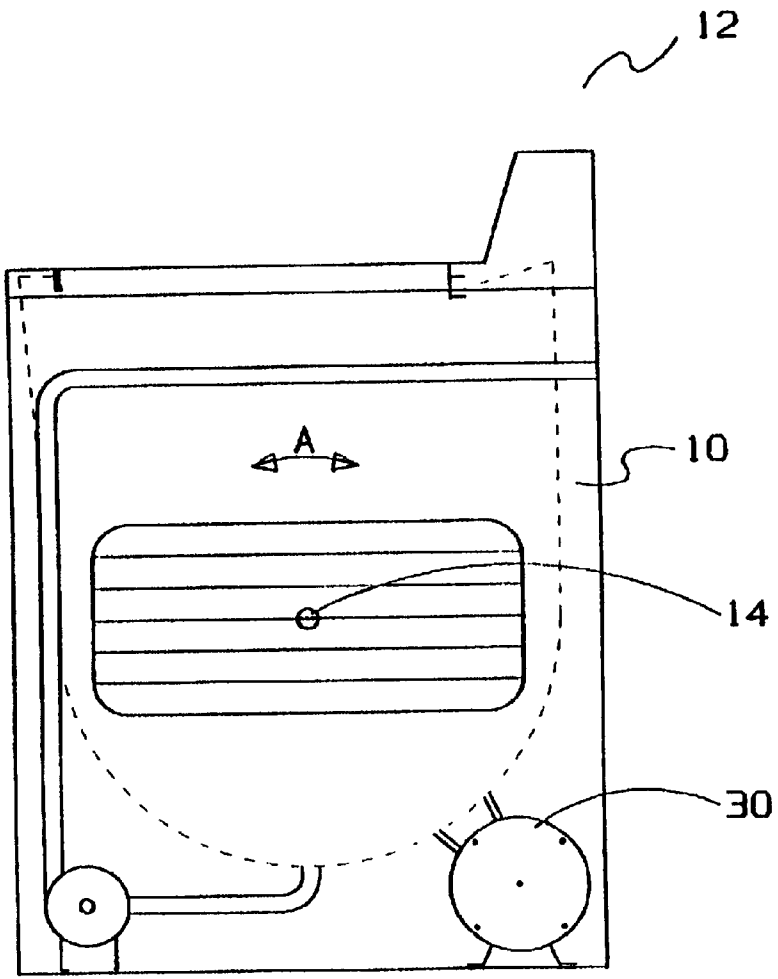
FIG. 5 is, in right side section view, the washing machine of FIG. 4.
Figure 4:
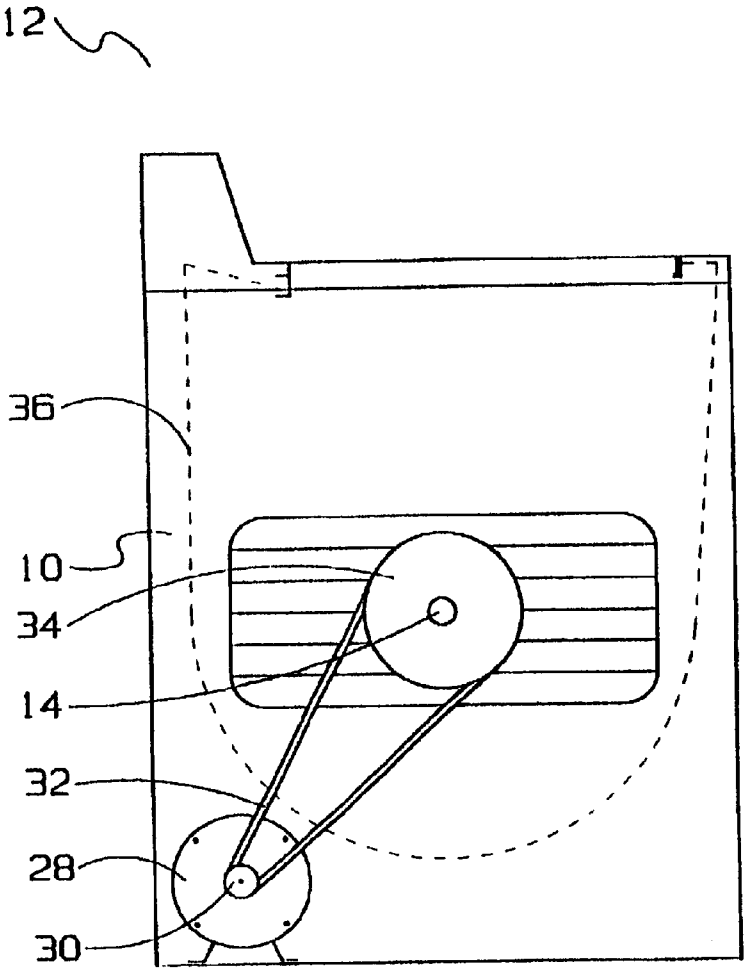
FIG. 4 is, in left side section view, a washing machine containing the sports equipment washer of the present invention.

Cage 10 as best seen in FIGS. 1, 4 and 5 may, as illustrated, be shaft mounted so as to extend between the laterally spaced-apart side walls of washing machine 12 or alternatively, wash tub 36. Cage 10 may be elongate, such as rectangular as depicted, and may be shaft mounted by means of longitudinally extending stub shafts or axles 14 rotatably mounted within water tight or sealed bearings known in the art so as to be journalled rotatably through side walls 16 of washing machine 12 or through the walls of wash tub 36. Advantageously, longitudinal stub shafts 14 lie along the longitudinal axis of symmetry of cage 10 so that, when empty, cage 10 is generally rotationally balanced about shafts 14.

In one embodiment illustrated, cage 10 has opposed upper and lower baskets 18*a* and 18*b* respectively, the upper and lower baskets sharing a common floor 20 which serves as a divider between the upper and lower baskets within cage 10. Hinged covers 22, hingedly mounted to an edge of each basket, maybe pivoted on hinges 24 so as to selectively close the opening aperture into the respective upper or lower basket. Latch or clasp 26 or the like may be provided to selectively releasably lock covers 22 down onto upper or lower baskets 18*a* or 18*b* respectively.

Articles of equipment such as sports equipment, fire-fighting suits, oil or otherwise contaminated apparel, books, liners, all requiring washing, may thus be placed into the upper or lower baskets and the covers 22 closed over the basket openings so as to enclose the articles within the baskets during the washing cycles. Because washing is facilitated by flushing water through cage 10, advantageously, cover 22, baskets 18*a* and 18*b*, and floor 20 facilitate the flow of water therethrough by means of a grid work, perforations, mesh or a spaced-apart array of elongate members, which may be rigid, semi-rigid, or somewhat resilient bars, struts, fabric, or mesh webbing or string or rope webbing stretched between rigid frame members or any like means of forming a container which will remain structurally intact when agitated about the axis of rotation of shafts 14 during a washing cycle when cage 10 contains sodden items of sports equipment. Thus, as illustrated, cover 22 is a mesh, and the upper and lower baskets are illustrated as comprising a spaced-apart array of generally horizontal bars supported by vertical posts, and floor 20 is illustrated as a grid work or mesh. It is understood however the illustrations are not intended to be limiting, as cage 10 may be constructed by any appropriate means such as described above or by other materials perforated or otherwise which may be known in the art to provide for the efficient passing of fluids therethrough while providing structural integrity while agitated as for example by means of the mechanism illustrated in FIGS. 4 and 5.

As seen in FIGS. 4 and 5, cage 10, which is rigidly mounted to stub shafts 14, may be agitated in direction A about the longitudinal axis passing through co-linear shafts 14. Agitation may be accomplished by means of a drive belt and pulley arrangement wherein, for example, a three-speed electric drive motor 28 rotates drive shaft 30 thereby turning drive belt 32. Drive belt 32 turns pulley 34 rigidly mounted on to an end of one of stub shafts 14 protruding from the side walls, where it is understood that the side walls may be side walls 16 or the side walls of washing machine tub 36 (shown in dotted outline) contained internally within washing machine 12. Thus if a programmable logic controller (not shown) is provided, electric motor 28 may be programmably driven to execute washing machine cycles and to alternate or change direction of agitation of cage 10 about shaft 14.

Figure 2:
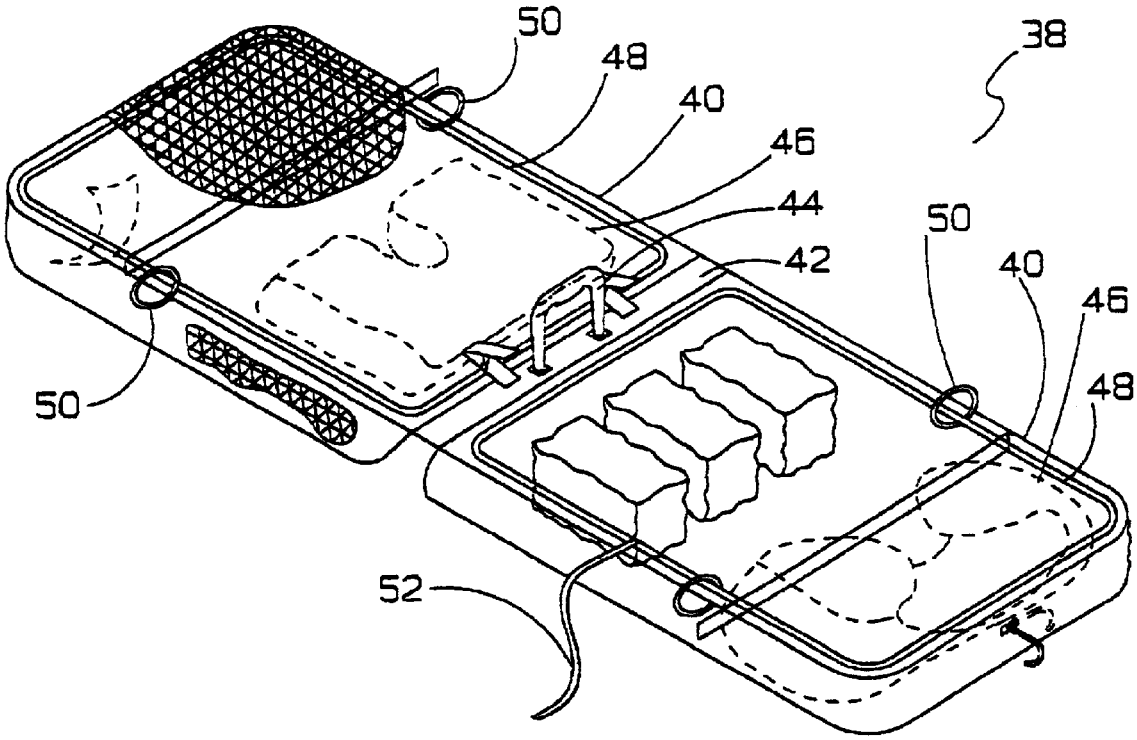
FIG. 2 is, in perspective view, a compartmentalized mesh equipment container laid flat according to a further aspect of the present invention.
Figure 3:
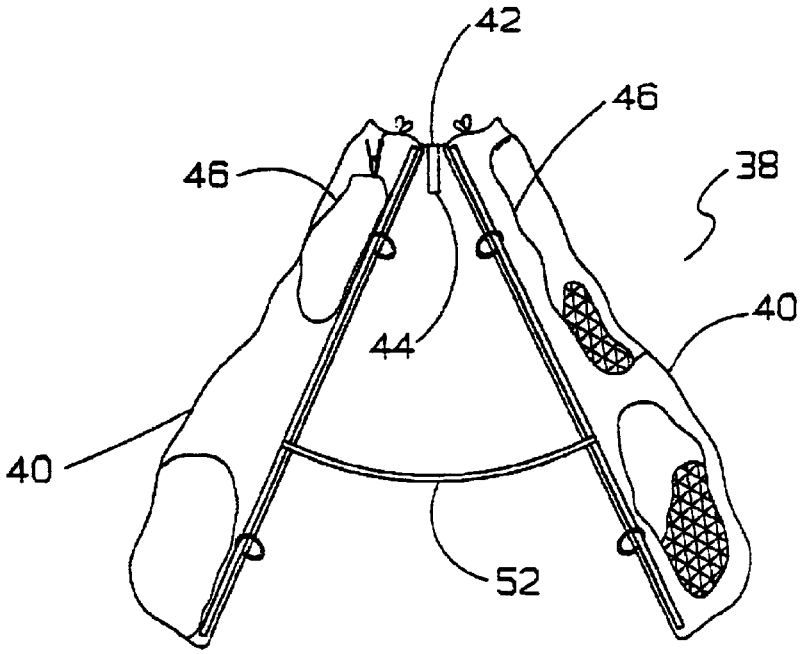
FIG. 3 is, in partially cut away side elevation view, the compartmentalized mesh equipment container of FIG. 2, partially folded.

In an alternative embodiment of the present invention, a mesh equipment container for example either rigid or flexible in the nature of a garment bag is, as illustrated in FIGS. 2 and 3, provided for securely holding in a convenient container the articles for washing. The container may be then easily and efficiently loaded into the correspondingly size baskets of cage 10. Mesh equipment container 38 may as illustrated, take the form of a garment bag. Whether rigid or flexible, the container is advantageously compartmentalized, for example having mesh side compartments 40 or the like extending in opposed relationship outwardly of a centrally disposed hinge 42 and handle 44. Side compartments 40 may be releasably closed by means of fasteners known in the art such as zippers or strips of hook and loop fasteners or the like, such that the openings which are conveniently large, may be opened to access the interior cavities of side compartments 40. Once articles, the illustrated example being sports equipment 46 (shown in dotted outline), have been inserted into their corresponding internal compartments within side compartments 40, and side compartments 40 closed by means of releasable fasteners 48, the mesh equipment container 38 may then be placed into a basket within cage 10 without the worry that a piece of sporting equipment has either been left out or may be left behind were it not for the convenient compartmentalized containment of equipment 46 within container 38.

Although not intended to be limiting, it may be that each basket of cage 10 is sized to receive one mesh equipment container 38 whether it be that container 38 is folded in half about hinge 42 or laid flat placed into the basket. The scope of this invention is not limited to one particular set of relative dimensions of container 38 or the corresponding dimensions of each basket of cage 10 so that it may be that container 38 for a particular sport or industry, (or other use where equipment may suffer from balling or knotting or tangling, for example because of the use of hook and loop fasteners on the equipment) in no way resembles a garment bag whether laid flat or folded in half so long as items of equipment may be conveniently held stationary within container 38, container 38 mounted or placed into cage 10, and so long as container 38 is made of material allowing for the free passage of water or cleaning solution therethrough. In the embodiment as illustrated, advantageously, tie down rings or clips may be provided to releasably secure container 38 within cage 10. Tether 52 may be provided to assist holding sides 40 in a partially folded orientation about hinge 42 so that container 38 may be free standing allowing for draining and drying of equipment 46 held therein.

Thus to reiterate, in one preferred embodiment the mesh equipment container has two large separate compartments each of which can contain a number of pockets which accept specific items of equipment (hockey equipment being illustrated). Modifications may be made to suit different sports or activities or industries. A reinforcing strip of fabric or plastic may be positioned transversely of the bag between the two compartments at the mid line, to permit the bag to be folded over conveniently in either direction. A carrying handle may be attached to the reinforcing strip. At least one face of each compartment may have a perimeter reinforcement, plastic or metal tubing to provide rigidity during the insertion of the soiled equipment. Additional pockets may be provided in each compartment and need only to be attached to the same face as the perimeter reinforcement since items placed in the extremity of the bag must slip past the pockets. A hook at one end of the container permits hanging of the bag for drying—note that hook may be stored in a concealed manner—and when the container is hung up, for example, the pants and shoulder pads are stretched by gravity into their normal shape. A strap is attached inside to restrain shoulder pads against movement during washing. Robust spring type clips may be attached to one compartment for securing the items such as padded hockey pants in place during the washing cycle, and an additional pocket may also be provided for odds and ends. The garment bag may also be provided with a means whereby it can be suspended within the washer cage as illustrated. I have shown rings through the mesh bag and around the perimeter reinforcement what ever that should be.

In use, the bag is folded open against the carrying handle and placed in an upright position supported by the perimeter reinforcement, a tether strap which is attached to one side of the bag is drawn toward and clipped to the other side of the bag to prevent the folded unit collapsing. The separate compartments which are closed by zippers or other means can be secured by the players personal identification tag. The internal pockets may have self closing elasticized openings. During transport, the bag is simply folded shut to expose the carrying handle and the tether strap is utilized to retain the bag in a closed folded position.

In a further alternative embodiment, the cage 10 may be cylindrical for insertion of items therein, or independently thereof or in addition thereto, cage 10 may be a drum or frame over or in which, that is, on the outside surface of which, or internally may be releasably mounted an equipment container 38 whether flexible, as in a mesh bag, or inflexible as in a pre-formed container, for example pie or wedge-shaped, or "C"-shaped.

Figure 6:
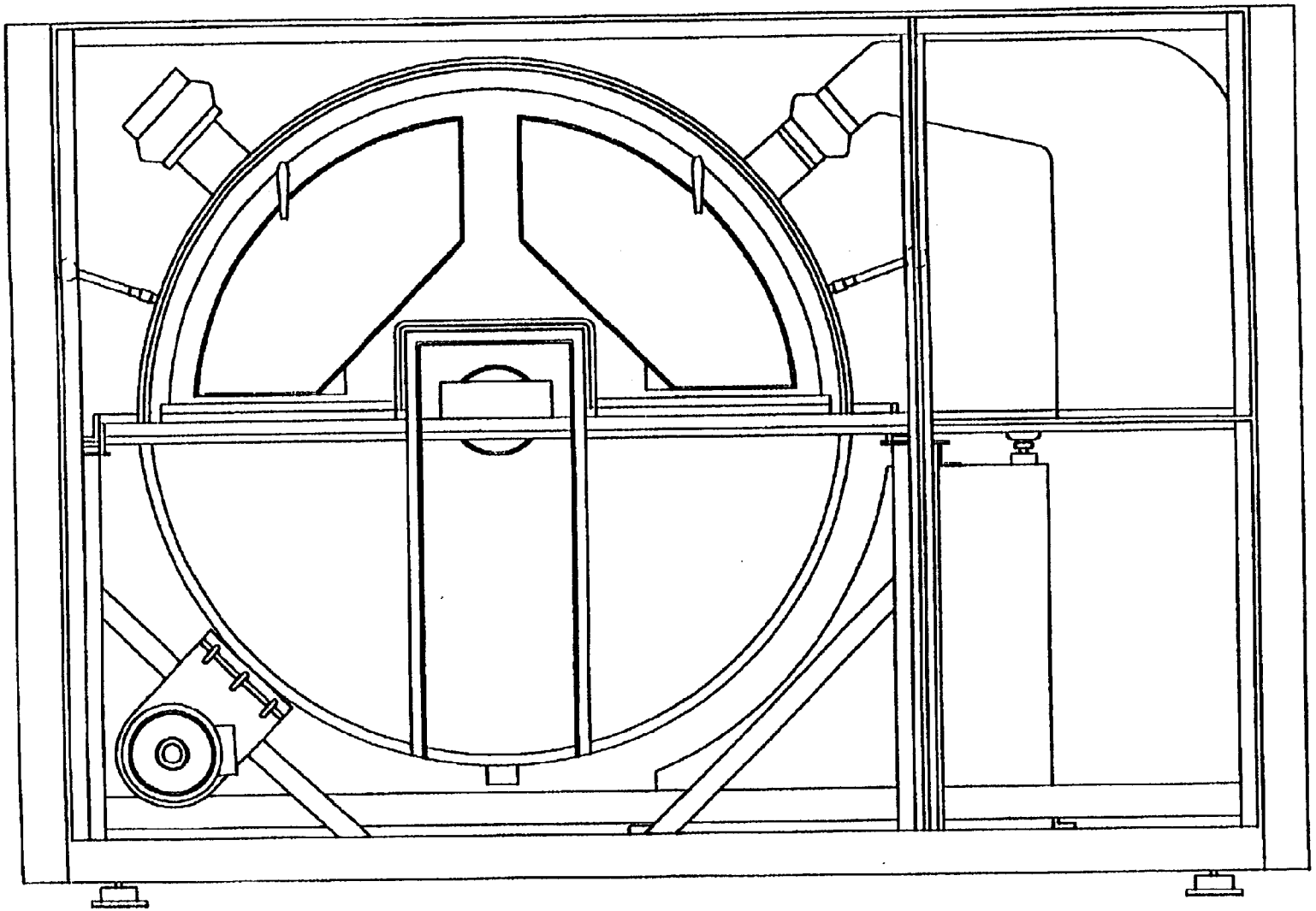
FIG. 6 is, in perspective view, an overview of an alternative embodiment of the machine of the present invention.
Figure 7A:
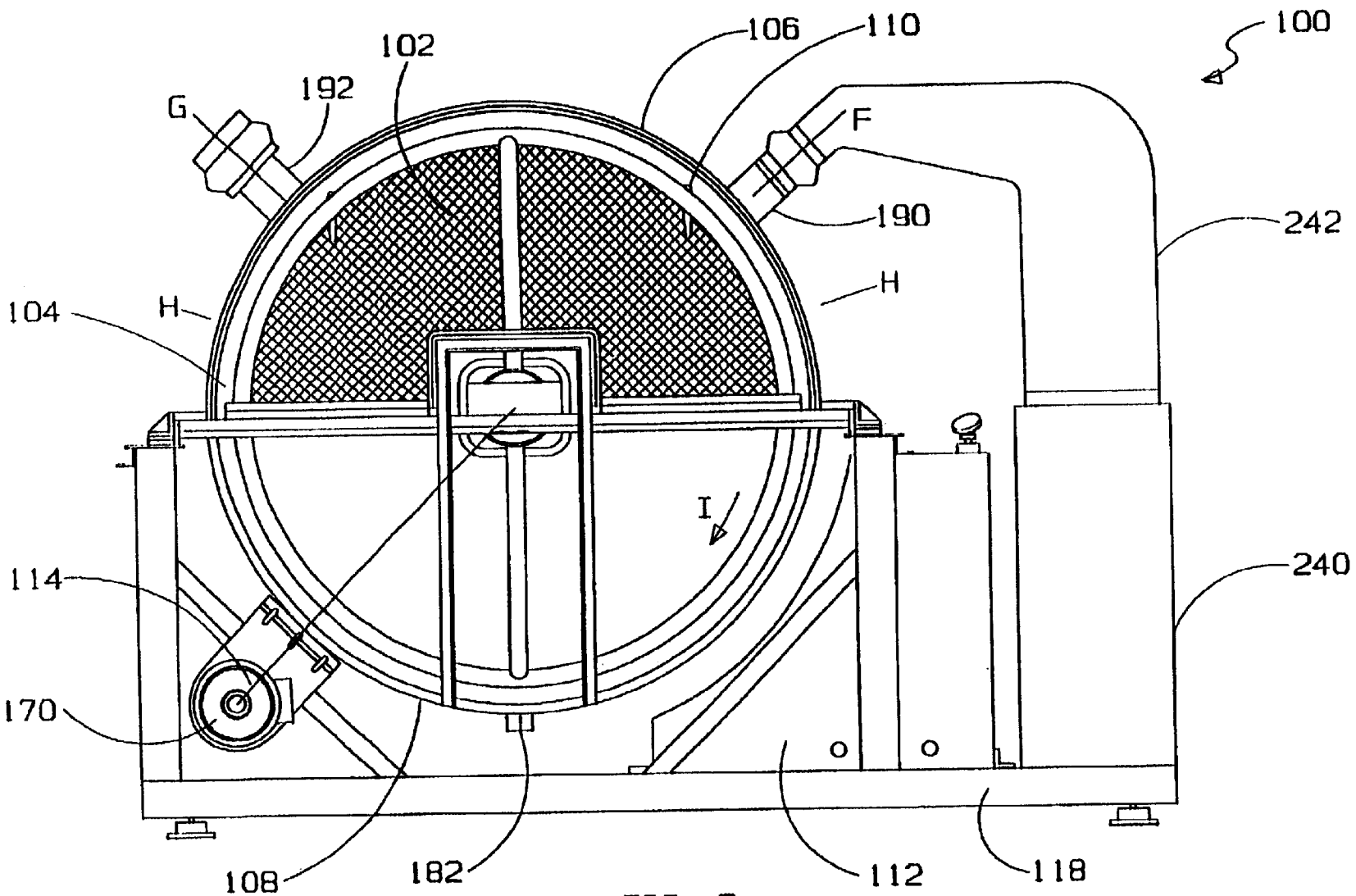
FIG. 7*a* is, in front elevation view, the machine of FIG. 6.
Figure 7B:
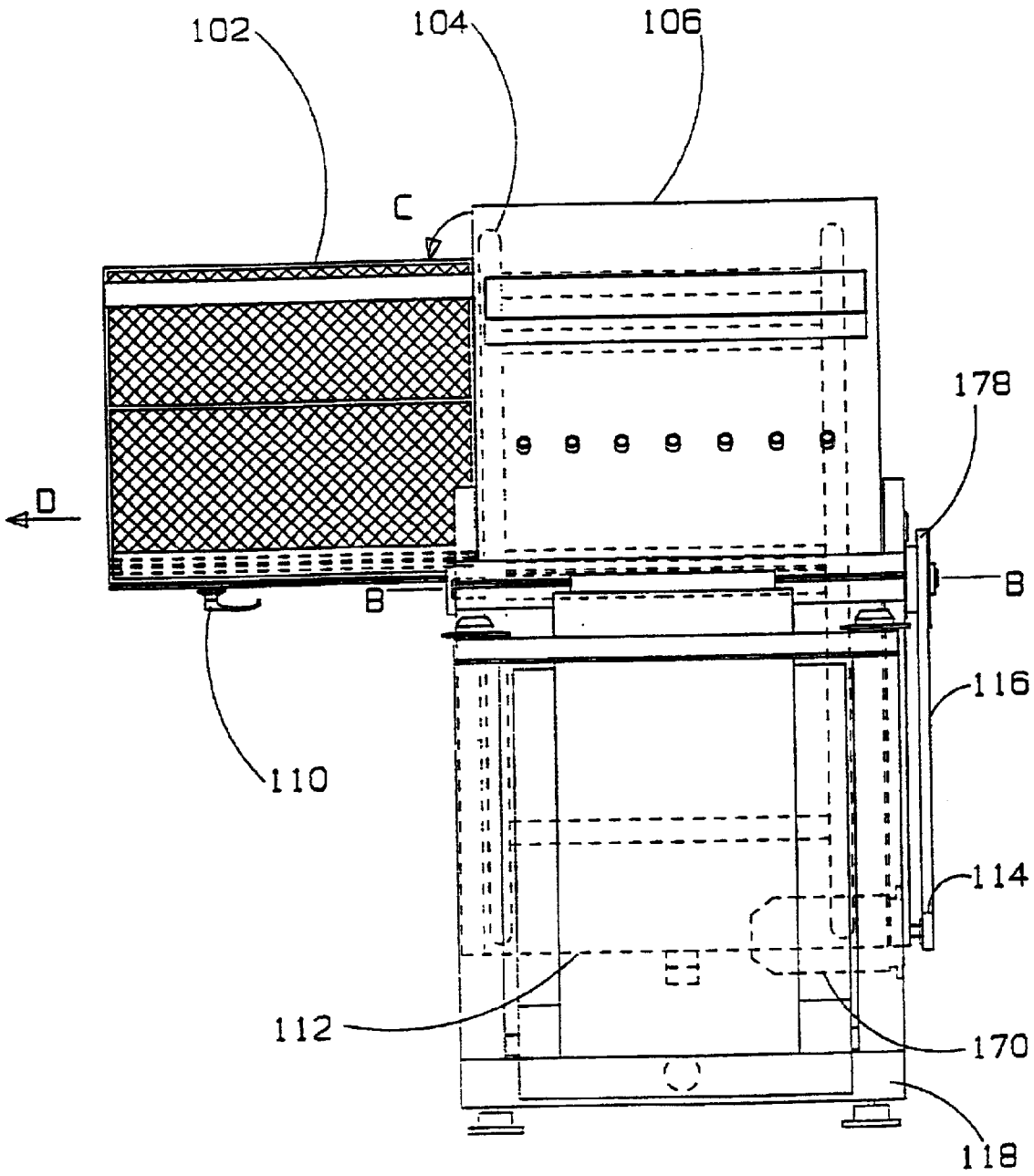
FIG. 7*b* is, in right side elevation view, the machine of FIG. 6.
Figure 7C:
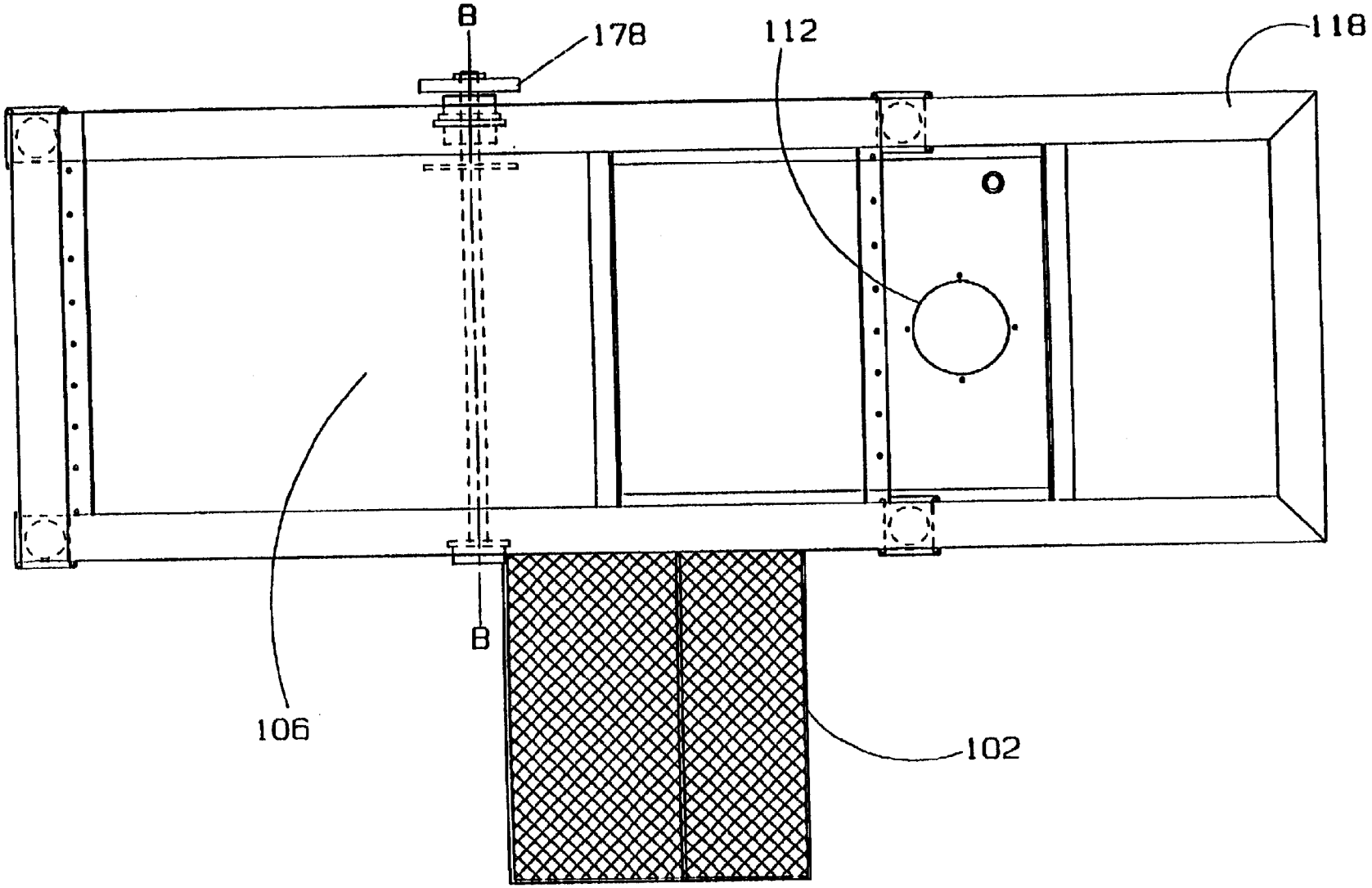
FIG. 7*c* is, in plan view, the machine of FIG. 6.

In a further alternative preferred embodiment, as seen starting in FIG. 6, the machine of the present invention is a combination washing and drying machine. Machine 100 employs a plurality of baskets 102 which are mounted within a cylindrically shaped cage 104. Baskets 102 are radially spaced in cage 104 about its axis of rotation B. Cage 104 is rotatably mounted so as to be free to turn about axis of rotation B within a cylindrical outer housing consisting of an upper tub 106 and a lower tub 108. Door 110 provides access into the front of upper tub 106. Door 110 is hinged to lower tub 108 and so may be folded down in direction C into its position shown in FIG. 7*b* which allows for access into the baskets or for one or more baskets 102 to be telescopically slid outwardly in direction D from the interior of upper tub 106. This provides access to the interior of the basket or baskets as further described below. Water for use during the wash cycle is stored in a reservoir water tank 112. Motor drive 114 rotates cage 104 and baskets 102 within the housing during the wash and dry cycles, for example by means of a belt drive linkage 116. A frame assembly 118 provides the supporting structure for the components.

Figure 8A:
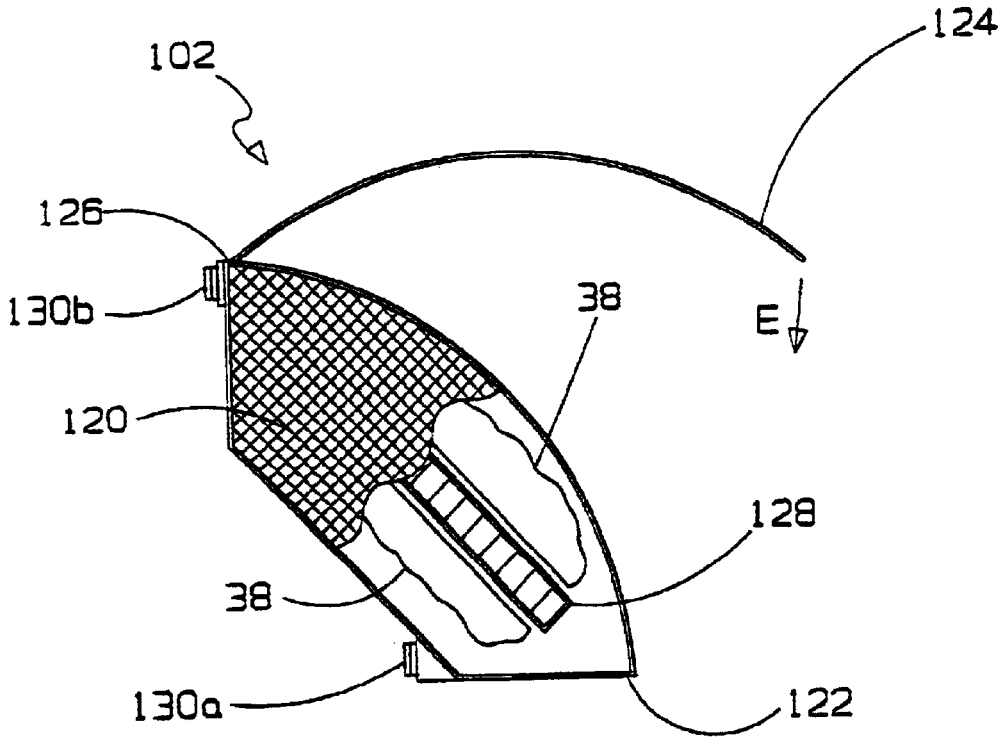
FIG. 8*a* is, in front elevation view, one basket of the machine of FIG. 6.
Figure 8C:
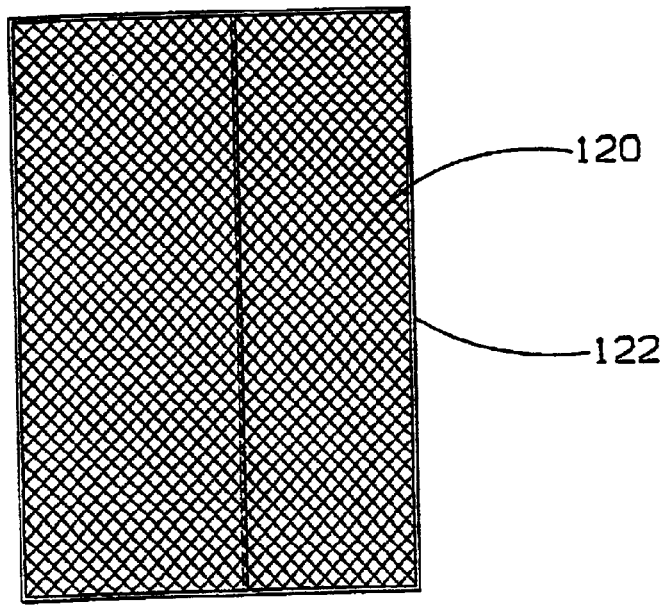
FIG. 8*c* is, in plan view, the basket of FIG. 8*a*.
Figure 8B:
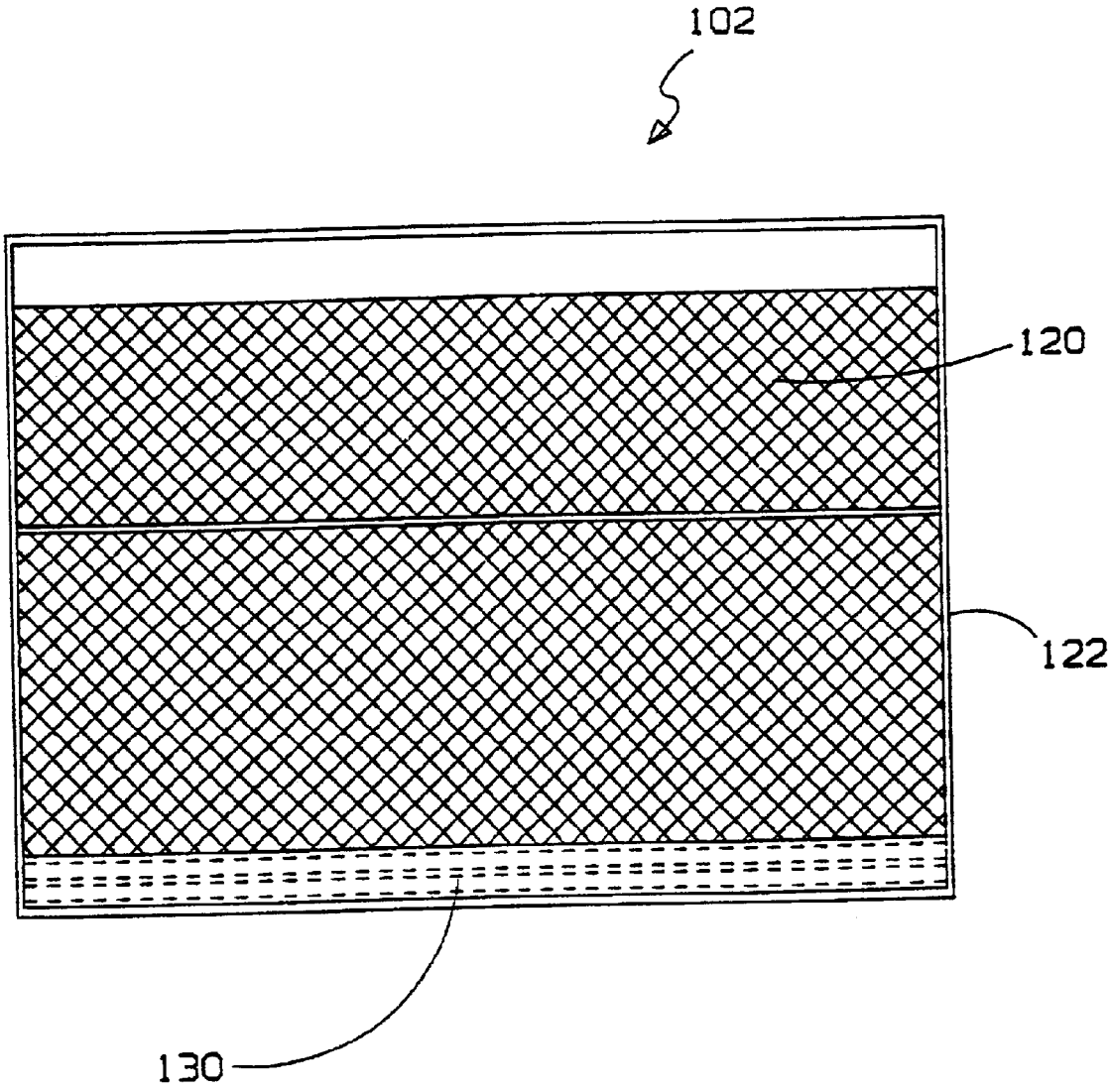
FIG. 8*b* is, in side elevation view, the basket of FIG. 8*a*.

As better seen in FIGS. 8*a*–8*c*, baskets 102 are advantageously each identical to one another, being constructed of an open weave mesh or the like, reference numeral 120 in the figures, rigidly mounted to rigid basket frame 122. Basket lid 124 also constructed of a mesh mounted within an outer frame, is mounted to basket frame 122 by means of hinges 126. Basket lid 124 may be closed in direction E and releasably fastened by means of clasps or the like in the closed position so as to enclose mesh equipment container 38 within the basket. Where the basket is sized so as to retain equipment container 38 in its folded position folded over about hinge 42, advantageously a rigid wire frame spacer 128 is placed between the folded over halves of equipment container 38 so as to allow the passage of water between the folded over halves or other means are used to hold the two halves of the bag apart to allow water penetration. For example, the door of the basket may, when closed, intrude in between the halves of the bags to hold the halves apart.

Sliders 130 are rigidly mounted so as to face outwardly from one side of frame 122. Sliders 130 allow for the telescopic mounting of baskets 102 into cage 104.

Figure 9A:
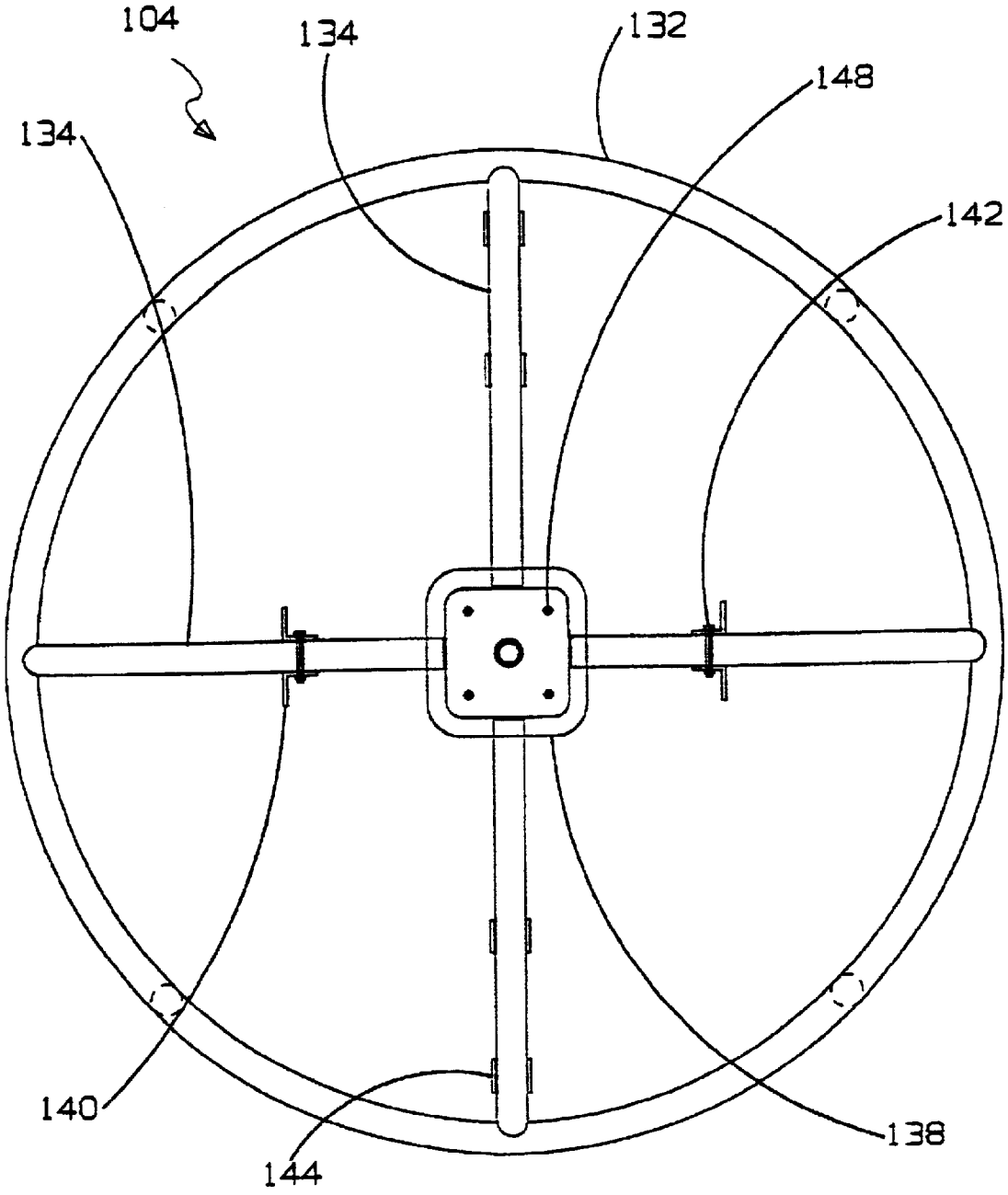
FIG. 9*a* is, in front elevation view, the cage of the machine of FIG. 6.
Figure 9B:
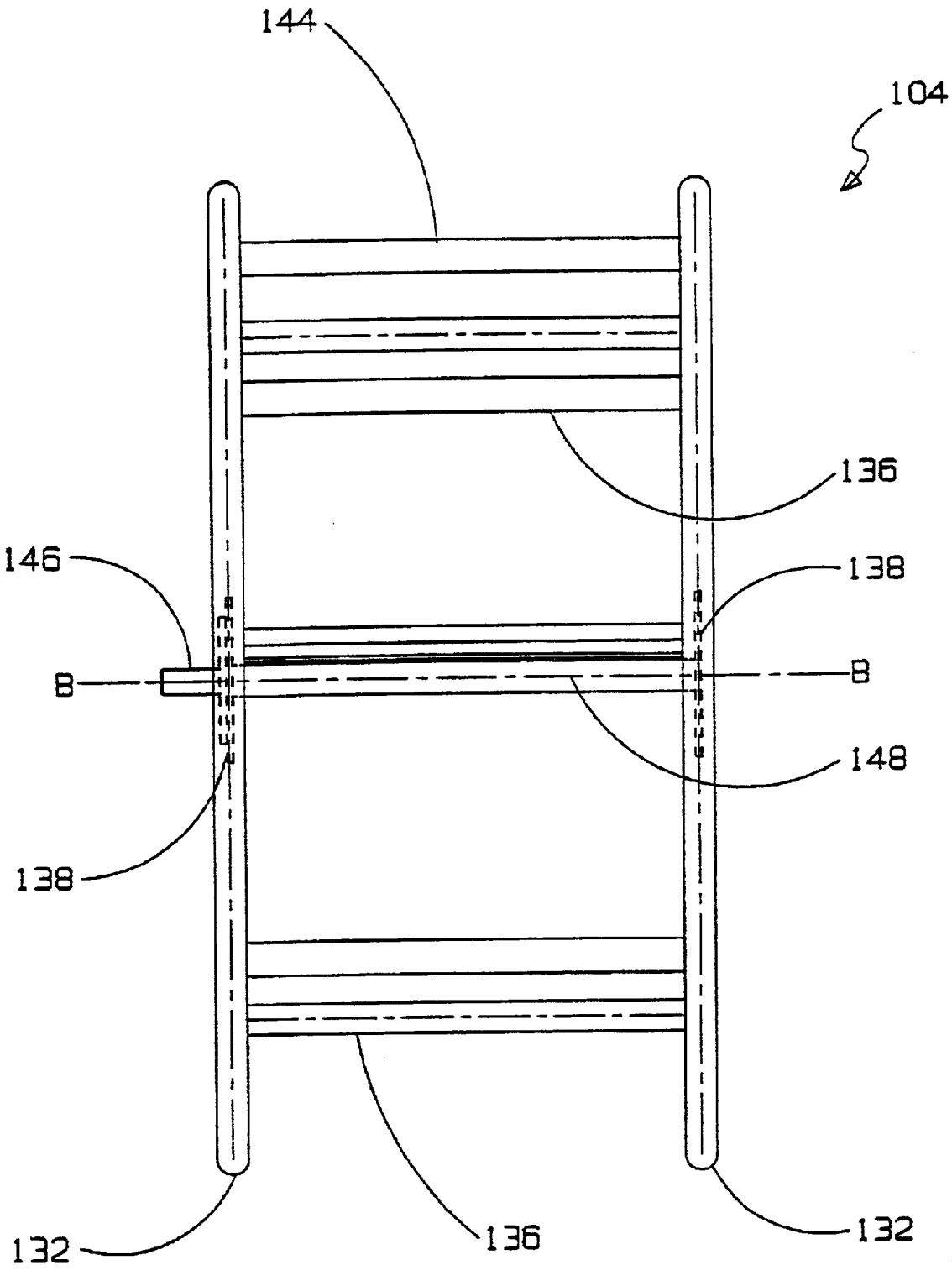
FIG. 9*b* is, in side elevation view, the cage of FIG. 9*a*.

As best seen in FIGS. 9*a* and 9*b*, cage 104 has rings 132 rigidly mounted to radial spokes 134. Rings 132 and spokes 134 are maintained in rigid parallel spaced apart relation by stringers 136. Center plates 138 are mounted rigidly at the intersection of the spokes. Stub shaft 146 is mounted to one of center plates 138 co-axially with axis of rotation B. Slider angle brackets 140 extend rigidly between the spokes parallel to axis of rotation B and center support 148. Slider plates 144 are mounted parallel to the stringers between rings 132.

Figure 10A:
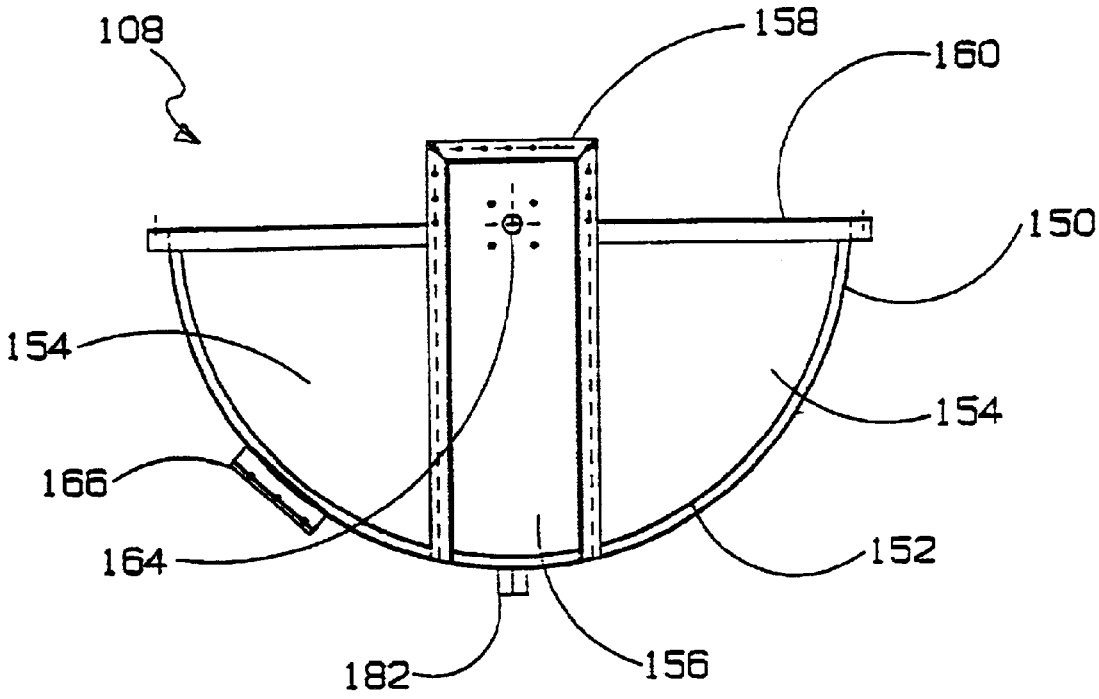
FIG. 10*a* is, in front elevation view, the lower tub of the machine of FIG. 6.
Figure 10C:
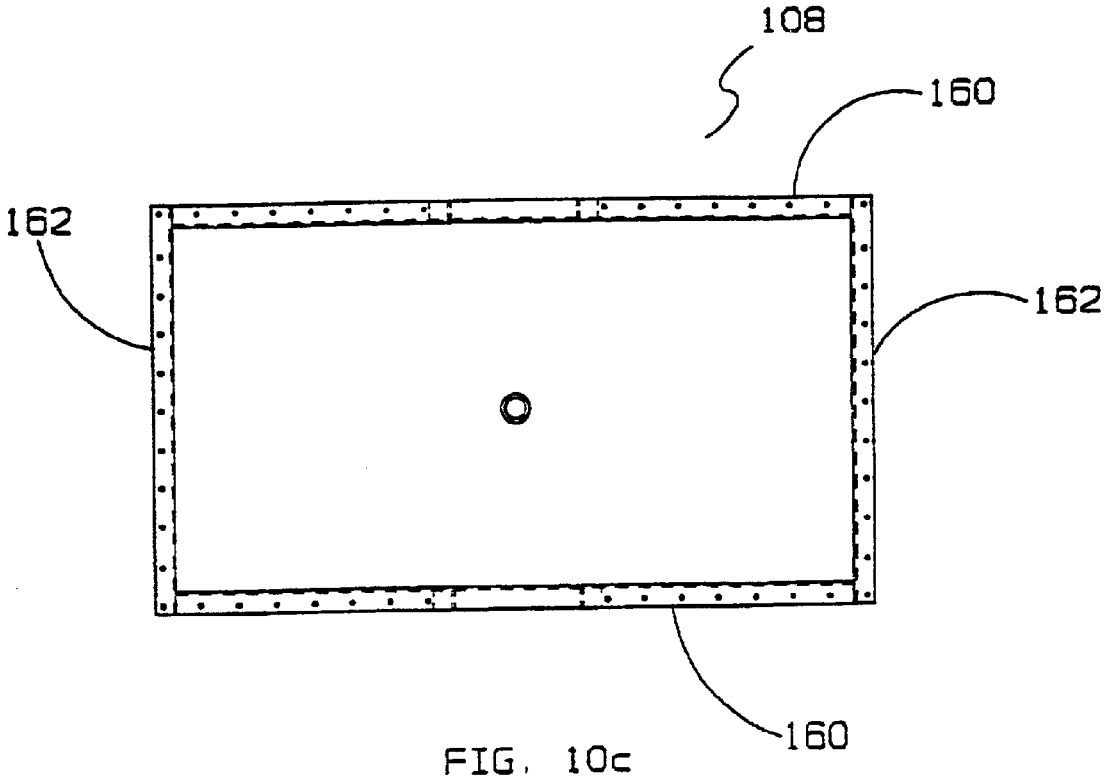
FIG. 10*c* is, in plan view, the lower tub of FIG. 10*a*.
Figure 10B:
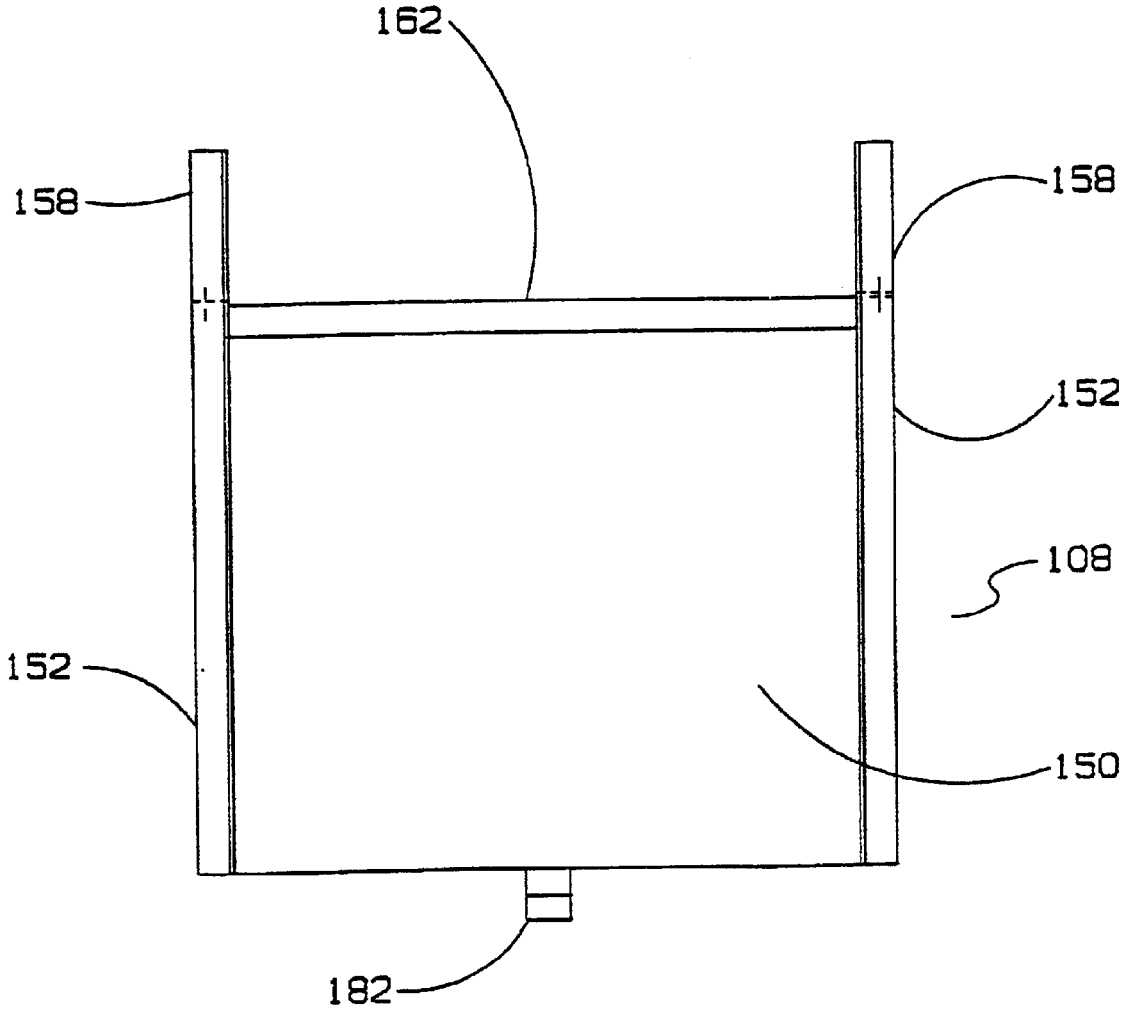
FIG. 10*b* is, in side elevation view, the lower tub of FIG. 10*a*.

As better seen in FIGS. 10*a*–10*c*, lower tub 108 has shell 150 rigidly mounted to stiffeners 152 so as to define, in cross section, a semi-circle. The front and back of shell 150, that is, between the interior of semi-circular stiffeners 152 is sealed by means of rigid plates 154 and 156. Rigid plates 156 are mounted within supporting stiffeners 158. Extending rigidly between the ends of stiffeners 152 are side angle members 160 and extending between the ends of the parallel adjacent stiffeners 152 across the upper edges of shell 150 are end angle members 162.

Plates 156 each have shaft apertures 164 formed therein for journalled mounting therethrough, through appropriate bearings, stub shaft 146 through one of the apertures and a drive shaft better described below through the opposite aperture. Motor mount 166 is mounted to one of stiffeners 152, so as to, for example, lay generally midway along one of the quadrants defined by stiffeners 152.

Figure 11B:
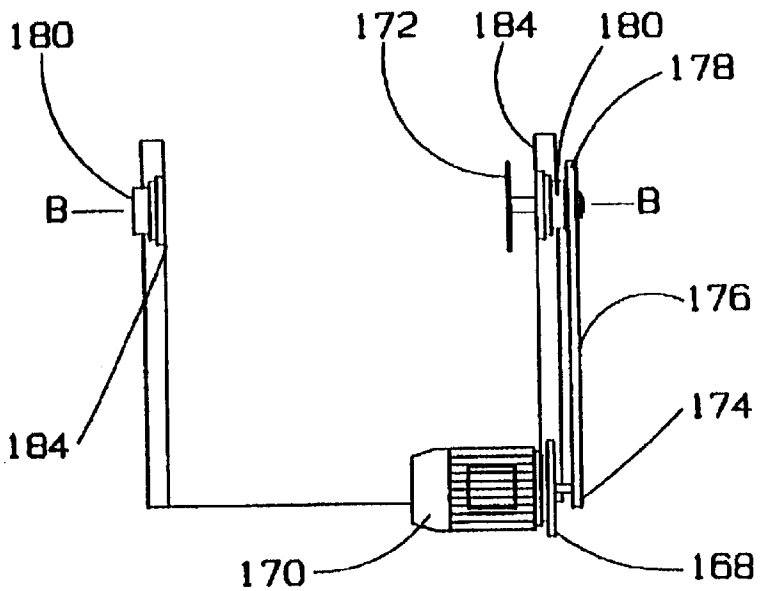
FIG. 11*b* is, in side elevation view, the drive motor and mount of FIG. 11*a*.
Figure 11A:
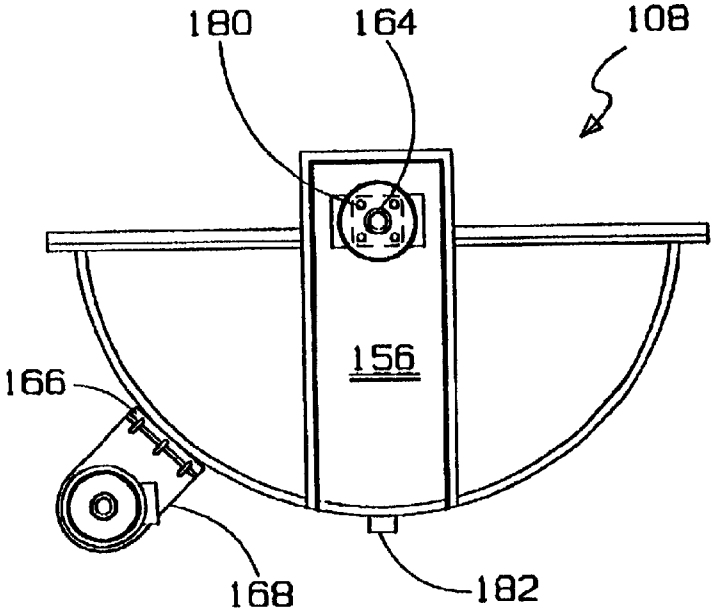
FIG. 11*a* is, in front elevation view, the drive motor and mount of the machine of FIG. 6.

As better seen in FIGS. 11*a* and 11*b*, motor mount flange 168 is rigidly mounted perpendicularly to motor mount 166. Drive motor 170, which is advantageously a reversible electric motor, is rigidly mounted to motor mount flange 168. Drive motor 170 may, for example be a Baldor™ No. VN3611T3 horsepower reversible electric motor. Drive motor 170 drives rotation of drive shaft 172 via sheave 174, timing belt 176, and sheave 178. Drive shaft 172 and stub shaft 146 are rotatably mounted within apertures 164 by their respective flange bearings 180 mounted to plates 156. Spacers 184 are rigidly mounted to side walls 154 and the interior of lower tub 108 through which cage 104 rotates when driven by drive motor 170. In the preferred embodiment, spacers 184 are perforated so as to assist in trapping or at least in dampening the energy of spray within the housing so as to facilitate drainage through pipe coupling 182.

Lower tub 108 may be drained of water through pipe coupling 182.

As seen in FIGS. 12*a*–12*d*, upper tub 106 has a semi-circular shell 186 extending between end angle members 188. Inlet duct 190 and exhaust duct 192 are mounted onto shell 186 so as to provide a drying airflow into, and out of, the interior of the housing comprising the upper and lower tubs. Inlet duct 190 has corresponding inflow access F which intersects the outflow access G of exhaust duct 192 at the center of curvature of shell 186. Advantageously, inlet duct 190 and exhaust duct 192 open into upper tub 106 across substantially the entire depth of the tub. A large volume of hot air as better described below, may thus be blown into the interior of the housing through inlet duct 190 an extracted as moisture laden air through exhaust duct 192.

Shell 186 is also braced by means of side angle members 194. End plate 196 is rigidly mounted to the back of shell 186 so as to seal the back of upper tub 106. The front of shell 186 is sealed when door 110 is closed, for example so as to compress an arcuate resilient door seal member 198 between door 110 and door frame 200. In the embodiment illustrated, door 110 is of a substantially transparent material so that the interior of upper tub 106 may be viewed when door 110 is closed. Door seal 198 may be held in place by means of a door seal retainer 202.

Further apertures are also provided through shell 186 into which are mounted pipe couplings 204 which in one preferred embodiment are ½ inch NPT pipe couplings. Pipe couplings 204 may have longitudinal flow axes H which may also intersect the center of curvature of shell 186. Pipe couplings 204 provide for inlet nozzles for the pressurized injection of soapy water or rinse water during the washing cycle as better described below.

Figure 12A:
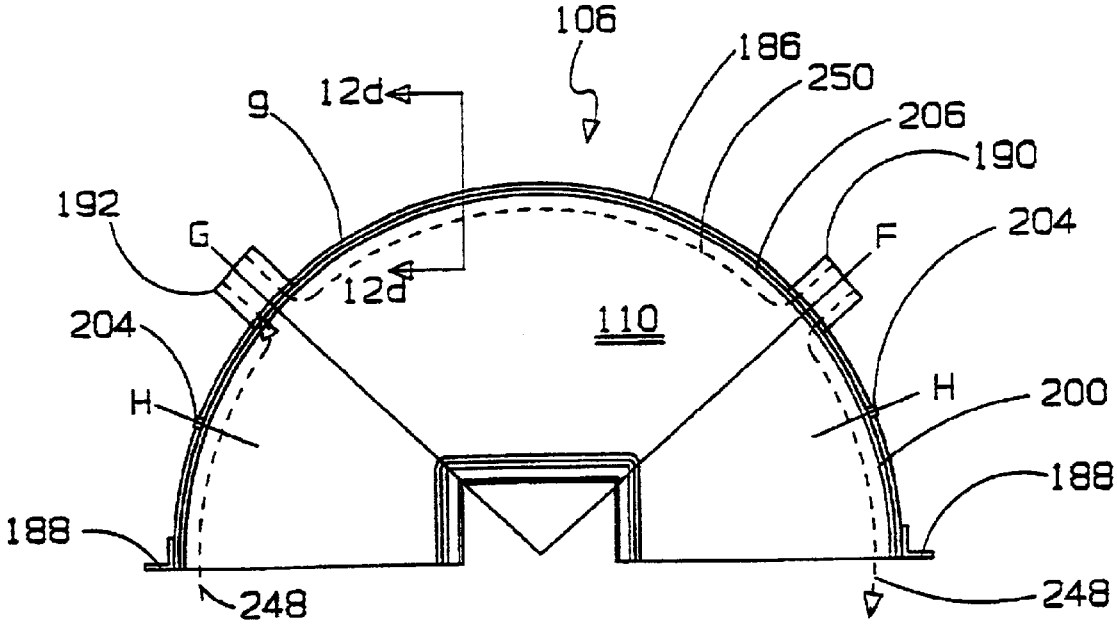
FIG. 12*a* is, in front elevation view, the upper tub of the machine of FIG. 6.
Figure 12C:
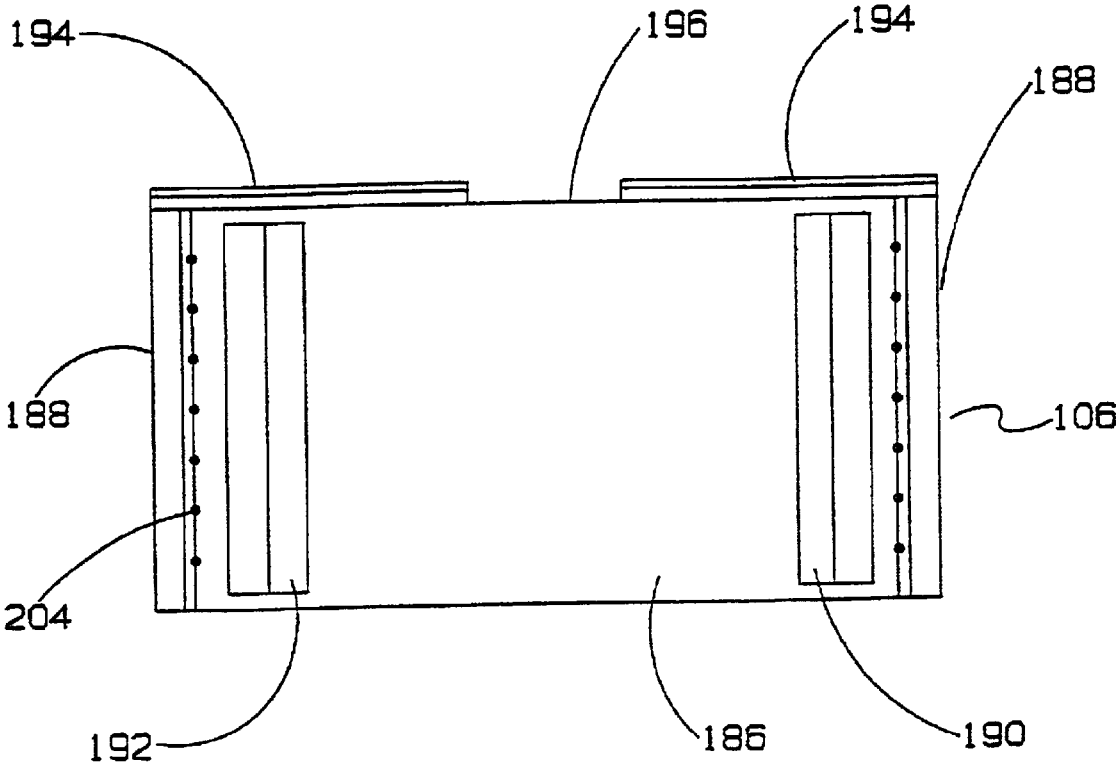
FIG. 12*c* is, in plan view, the upper tub of FIG. 12*a*.
Figure 12B:
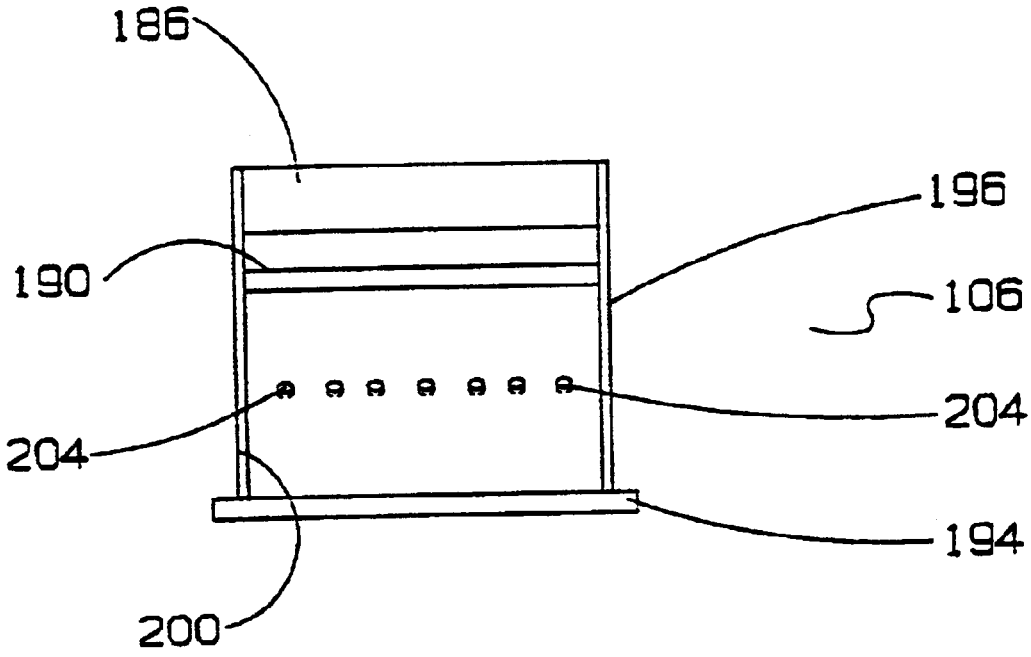
FIG. 12*b* is, in side elevation view, the upper tub of FIG. 12*a*.
Figure 12D:
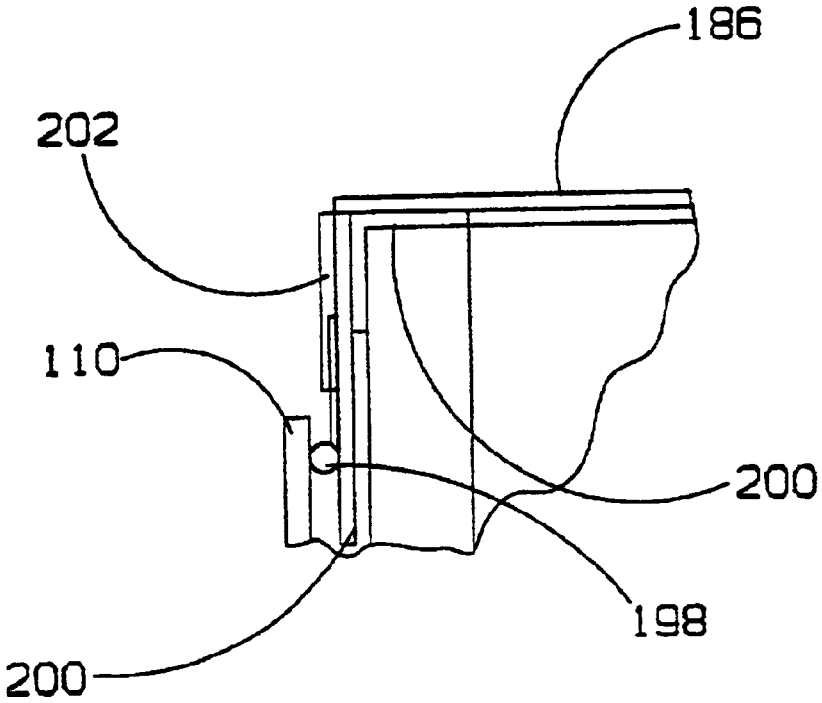
FIG. 12*d* is a sectional view along line 12*d*—12*d* in FIG. 12*a*.

As also seen in FIG. 12*a* a perforated splashguard 206 is mounted as a liner within shell 186 and provides for dampening of water spray within the tub, for example thrown from baskets 102 during the spin dry cycle.

Figure 13A:
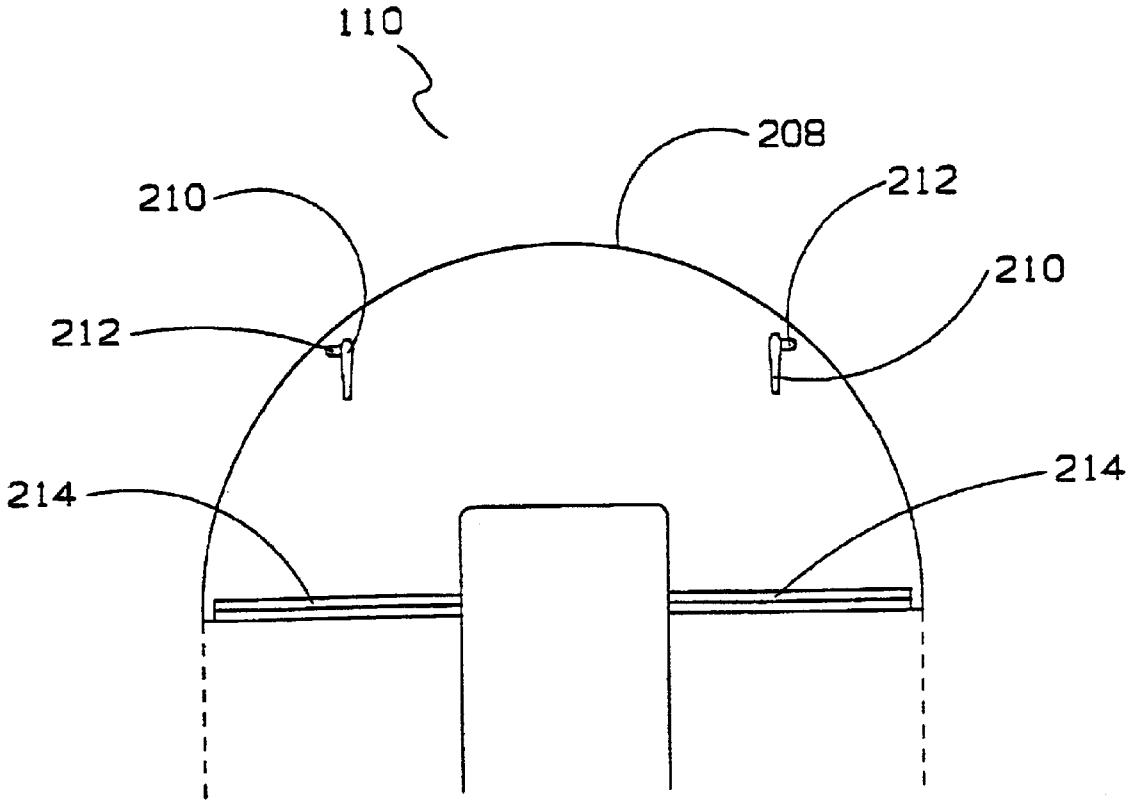
FIG. 13*a* is, in front elevation view, the door of the machine of FIG. 6.
Figure 13B:
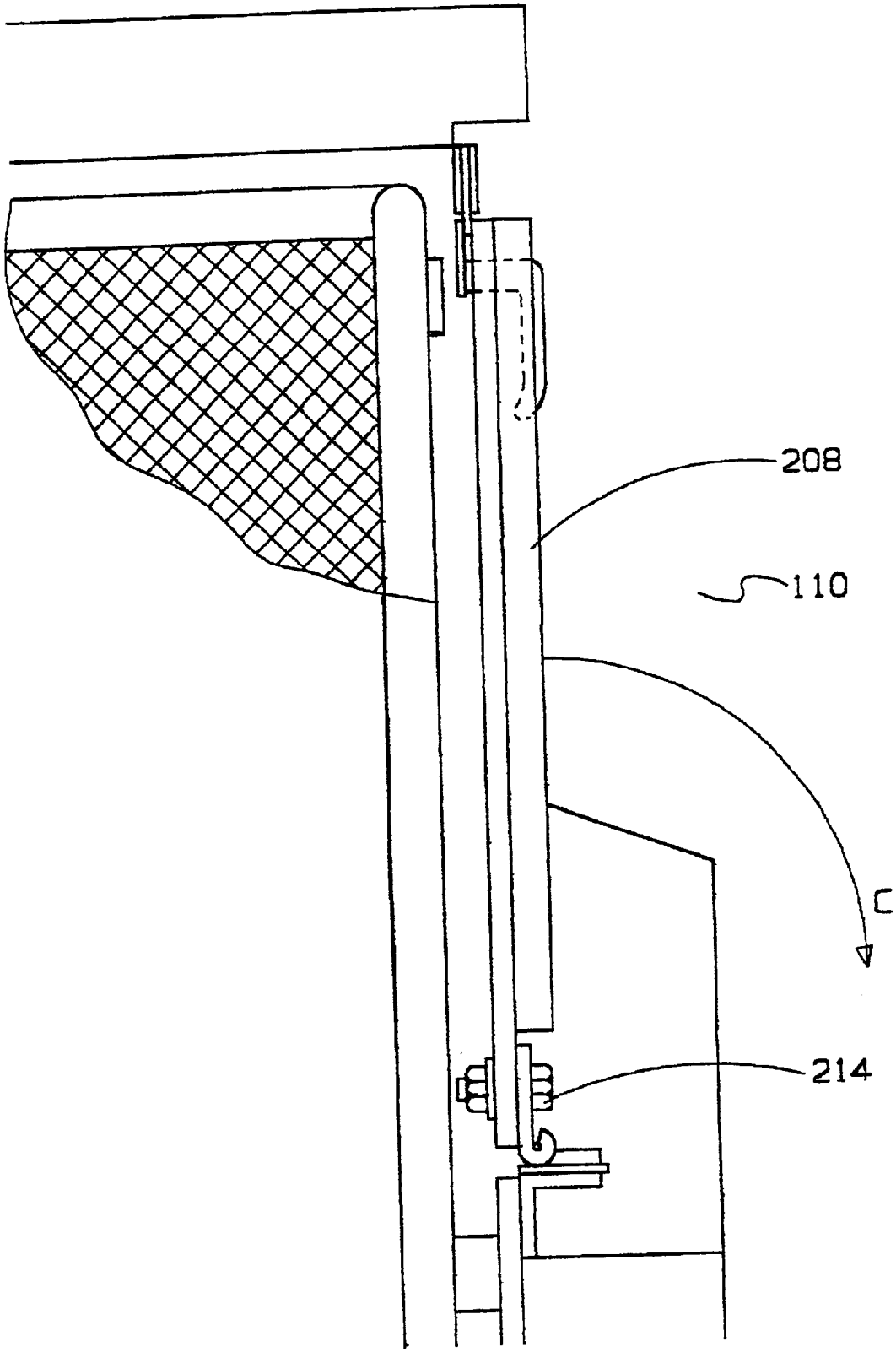
FIG. 13*b* is, in side elevation view, the door of FIG. 13*a*.

As better seen in FIGS. 13*a* and 13*d* door 110 may be a transparent sheet 208, for example a polycarbonate sheet of ¼ inch thickness preferably with a scratch resistant coating. Sheet 208 is releasably locked into its closed position against door frame 200 and corresponding door seals 202 by turning handles 210 so as to engage latches 212. With latches 212 disengaged from engagement with door frame 200, sheet 208 may be pivoted downwardly about hinges 214 in direction C into the door's open position so as to provide access into the upper tub.

Figure 14A:
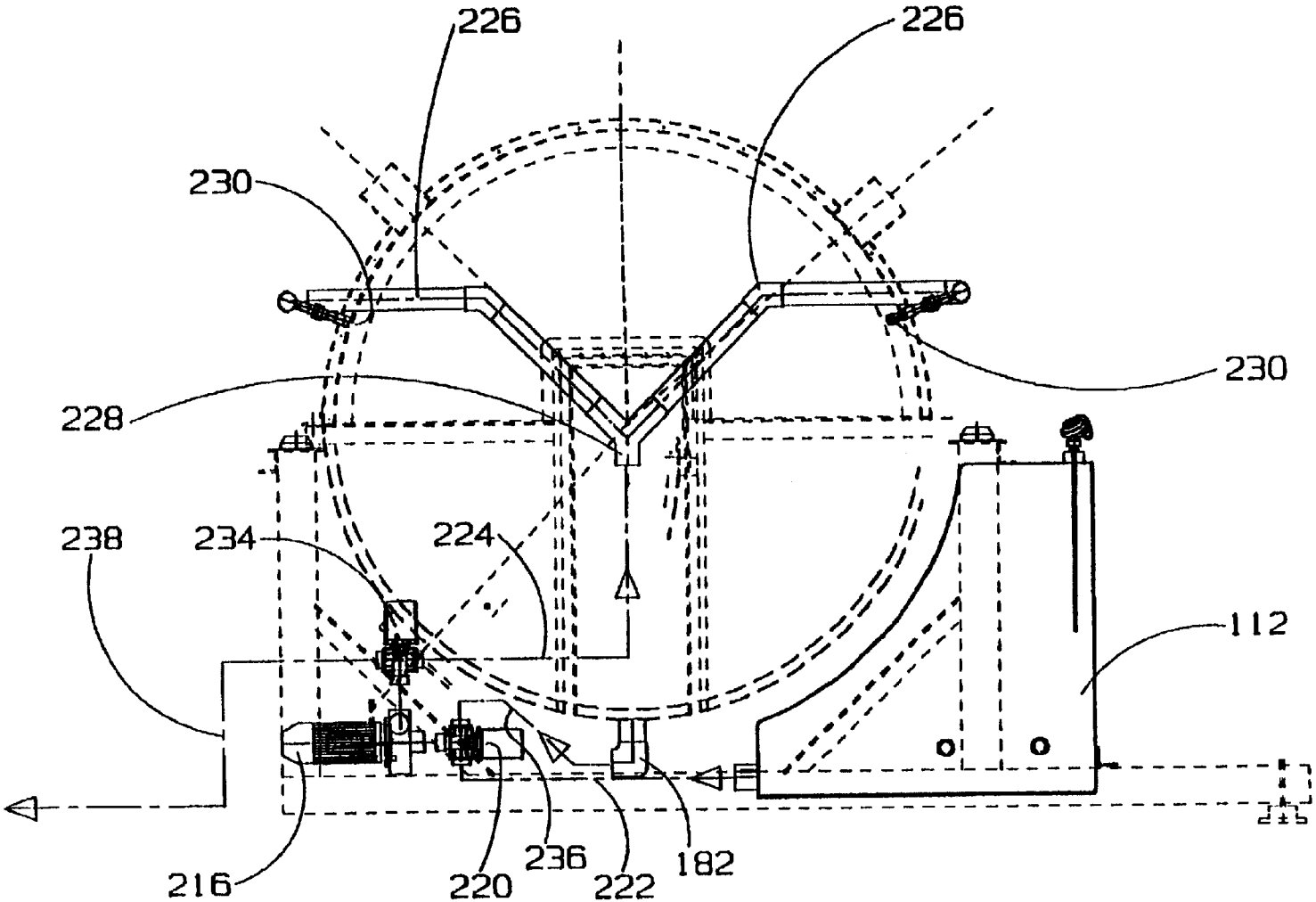
FIG. 14*a* is, in diagrammatic front elevation view, the water control system of the machine of FIG. 6.
Figure 14B:
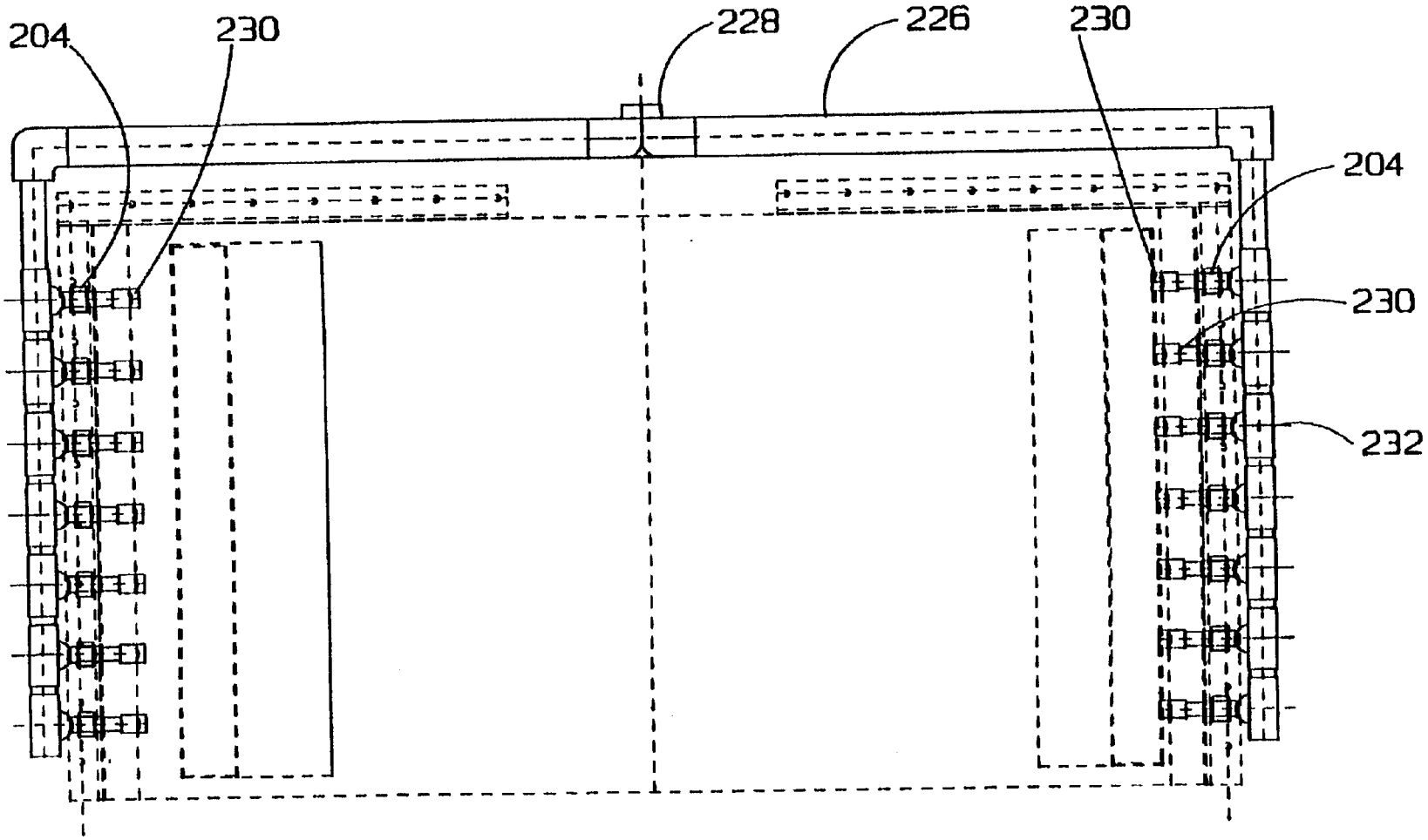
FIG. 14*b* is, in plan view, the spray nozzle water conduits of the water control system of FIG. 14*a*.
Figure 14C:
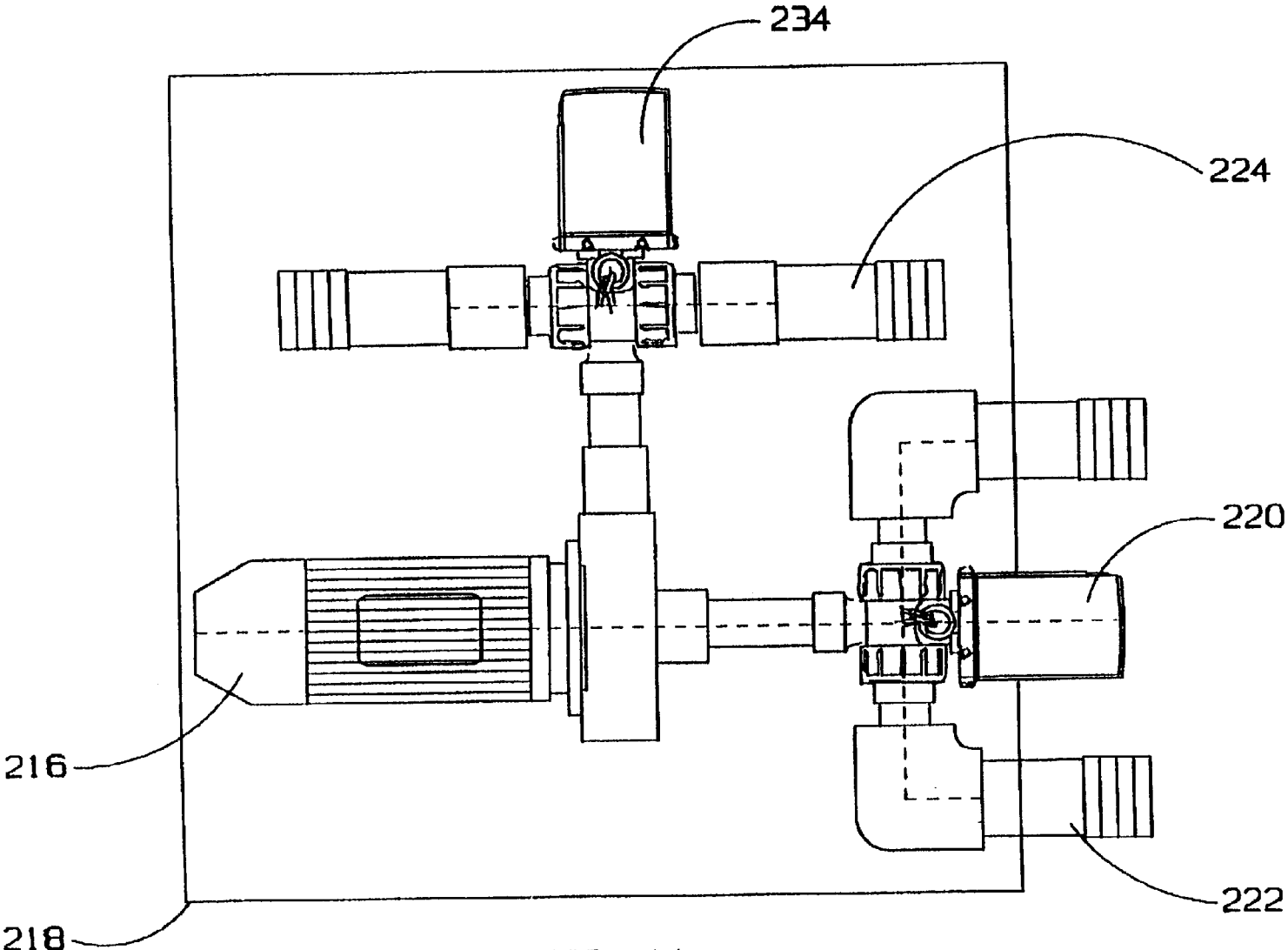
FIG. 14*c* is, in front elevation view, the water pump and valve arrangement of the water control system of FIG. 14*a*.

As seen in FIGS. 14*a*–14*c*, the control system of the present invention, programmed as would be known to one skilled in the art and user actuated by on/off switches 252 directs water from water tank reservoir 112, advantageously holding approximately 80 gallons, through jet pump 216 mounted to base plate 218, via electrically actuated control valve 220 and reservoir water line 222. Water is drawn from the reservoir and pumped by jet pump 216 through water line 224 and water conduits 226 via wide junction 228 so as to supply water to spray nozzles 230.

Spray nozzles 230 are mounted to pipe couplings 204 so as to project into the interior of upper tub 106 through splashguard 206. Water conduits 226 form a yoke having longitudinally extending arms extending across the depth of upper tub 106 so as to provide pressurized water flow to pipe couplings 204 via T couplings 232.

Water flow into water conduits 226 via water line 224 from jet pump 216 is controlled by electrically actuated valve 234. Once the contents of water tank reservoir 112 has been pumped into the tub housing, that is, the housing comprising the upper and lower tubs, valve 220 is actuating so as to close off water line 222 and open drain line 236. Drain line 236 drains water from drain pipe coupling 182, that is, from the bottom of lower tub 108. Thus either soapy water during the wash cycle or rinse water during the rinse cycle may be recycled into the tub by being pumped from the drain back up to the spray nozzles during both the wash and rinse cycles. Once each cycle has completed, it is then necessary to drain the tub, for example of either the wash water or the rinse water before the next sequential cycle may be commenced. This is accomplished by actuating valve 234 so as to redirect water being pumped from jet pump 216 from water line 224 to water discharge line 238. The timed actuation of valves 220 and 234 in conjunction with the cycling of motor drive 170 as better described below, is controlled by programmable logic controllers or the like such as would be known in the art. Thus as the wash cycle is progressing, once reservoir 112 has been depleted and water line 222 shut off by actuation of valve 220, reservoir 112 is replenished awaiting either a further wash cycle or a rinse cycle. Soap for the wash cycle may be introduced by various means, for example either manually or automatically using liquid detergent or dissolvable solid detergent injected into the tub or an infeed water line, for example by use of an automatic dissolvable cartridge-type solid detergent dispenser 244 such as sold under their trademark Prizm™ and manufactured by Sunburst Chemicals of Minneapolis, Minn., U.S.A. Dispenser 244 dispenses soap via feed line 246.

As an example of the wash cycle, although not intended to be limiting, drive motor 170 may rotate cage 104 and baskets 102 in a first rotational direction about axis B for two minutes and then sequentially reverse directions every two minutes thereafter until the wash cycle is complete, for example after a total of 9 or 10 minutes. The wash cycle is accomplished by spinning rotation as opposed to agitation style rotation. The soapy water is then pumped from the tub and either another wash cycle commenced with fresh soapy water or the rinse cycle commenced. The speed of rotation of cage 104 during the wash cycle is relatively low, for example 9 rpm. The speed of rotation of the cage during the rinse cycle may typically also be 9 rpm. During a spin dry cycle, however, the rotational speed of the cage is increased to at least 200 rpm so as to centrifugally force water radially outwardly from the articles contained in the baskets. The subsequent drying cycle is accomplished by forcing hot air into the tub while rotating the cage in direction I at 9 rpm. Cage 104 is rotated in direction I so as to draw the hot air being forced into the tub along axis F through inlet duct 190 around the longest circumferential path (labelled path 248 in FIG. 12*a*) within the tub between inlet duct 190 and exhaust duct 192. It has been found that otherwise, the hot air being forced through inlet duct 190, if cage 104 is being rotated in a direction counter to direction I, exits through exhaust duct 192 (i.e., along path 250) with a minimal drying effect on the contents of baskets 102.

Hot air is provided by furnace 240 through flume 242, for example at 2500 c.f.m. As would be known to one skilled in the art, the water in reservoir 112 may be supplied at or heated to a selectively controllable temperature (controlled by for example thermostat 254). The hot air being forced through inlet duct 190 would also be supplied at a selectively controllable temperature by the furnace.

Figure 15:
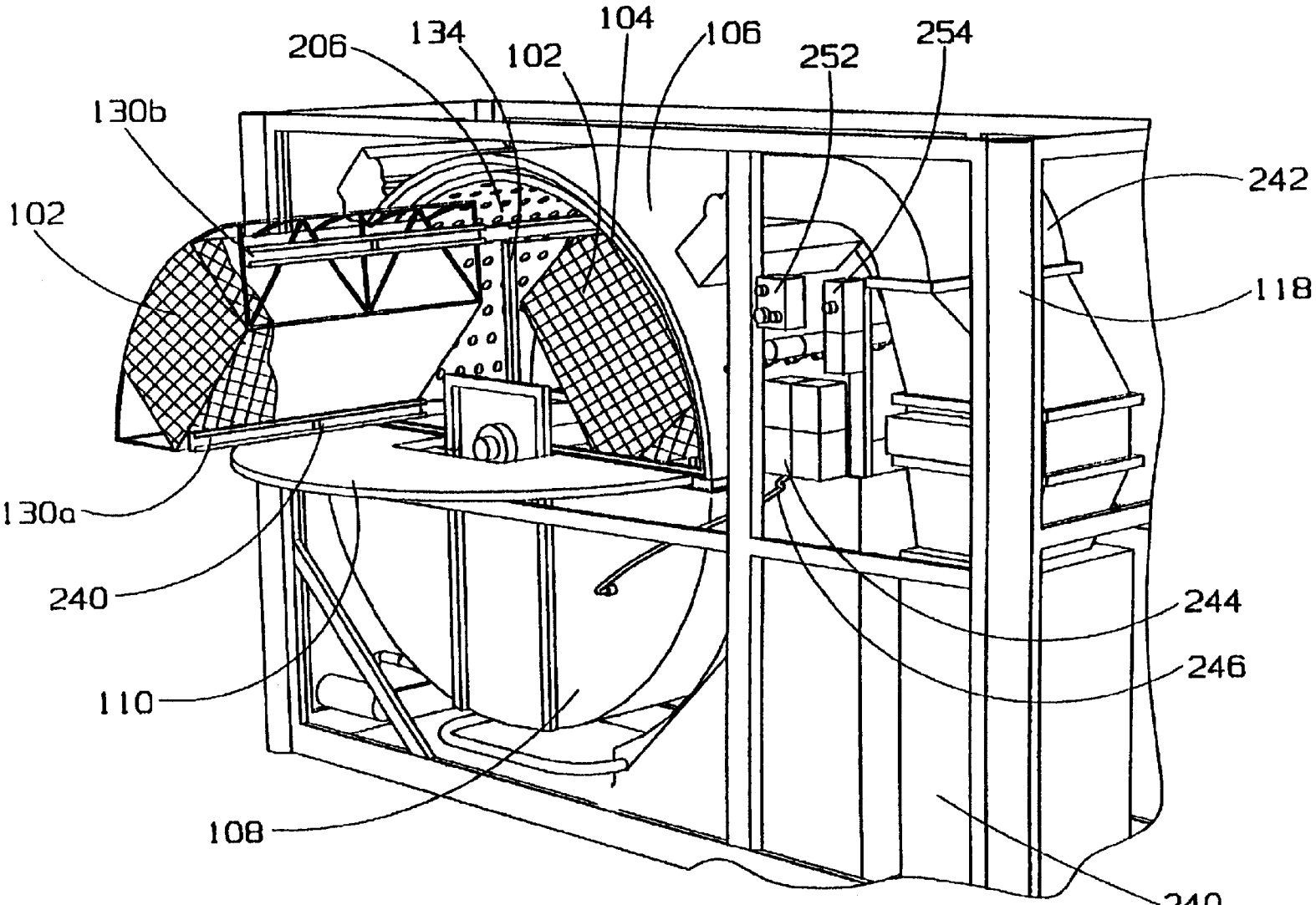
FIG. 15 is, in right side perspective view, the machine of FIG. 6 with the door open and a basket slid outwardly from the cage.
Figure 16:
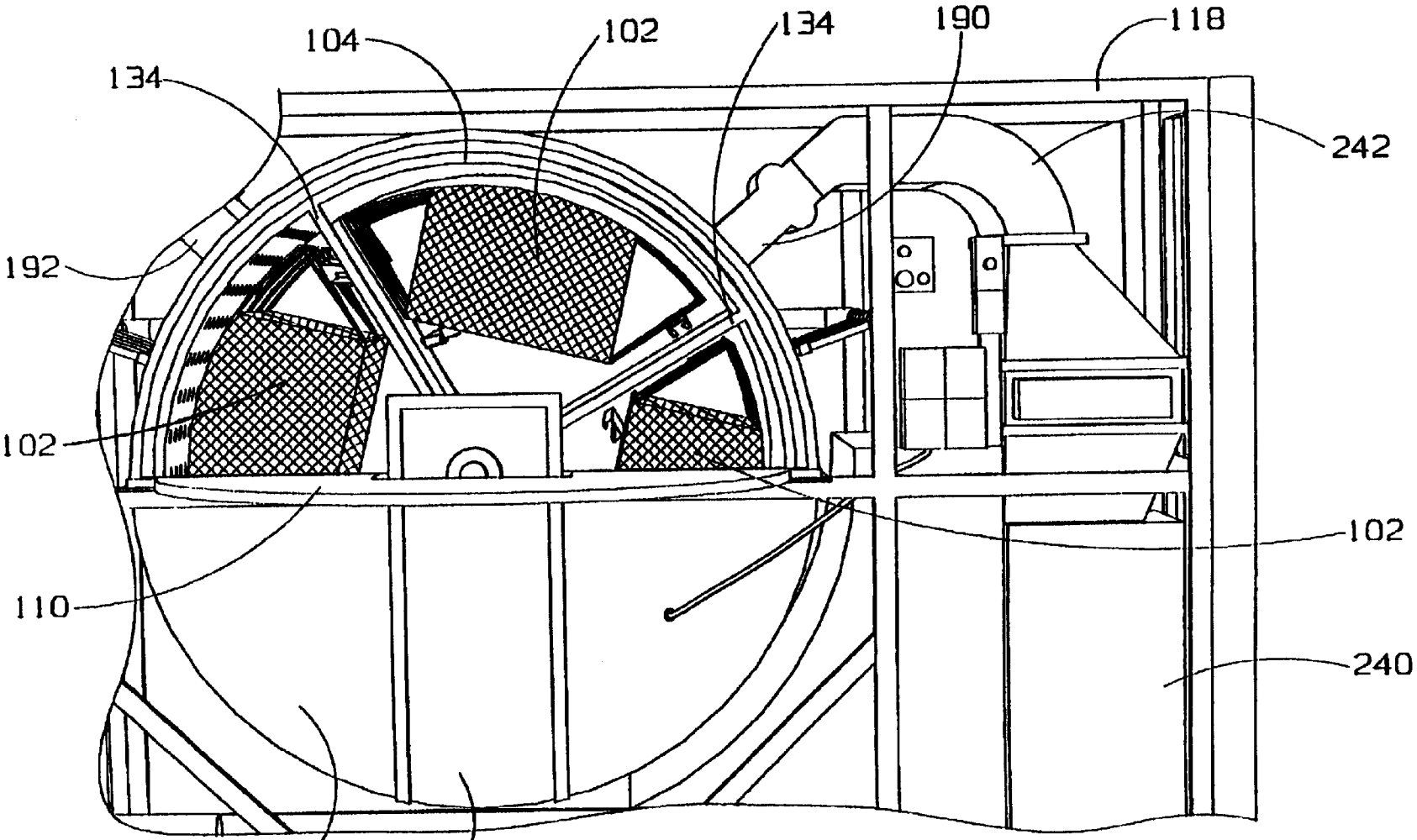
FIG. 16 is, in front elevation view, the machine of FIG. 15, with the door open.
Figure 17:
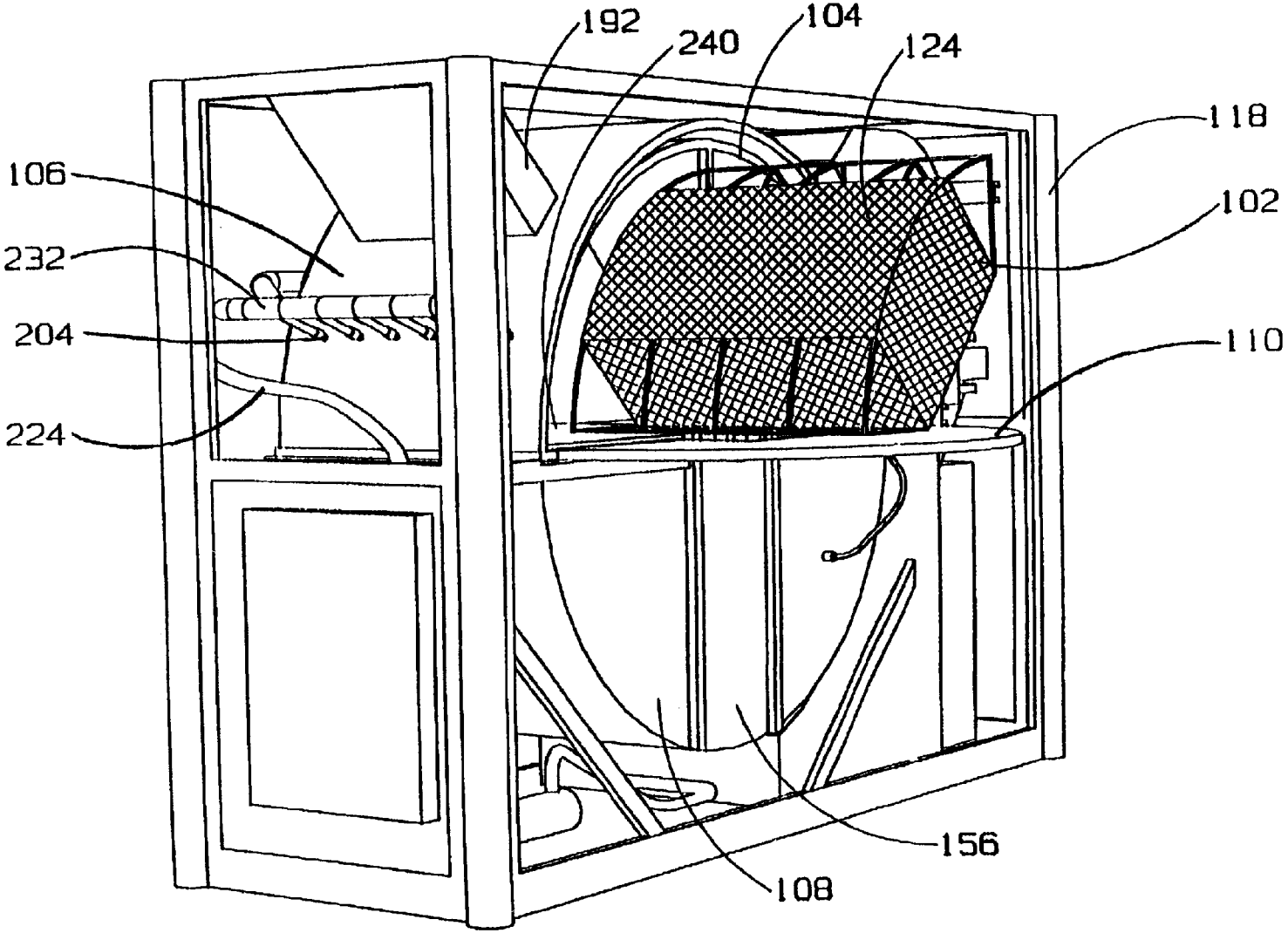
FIG. 17 is, in left side perspective view, the machine of FIG. 15.
Figure 18:
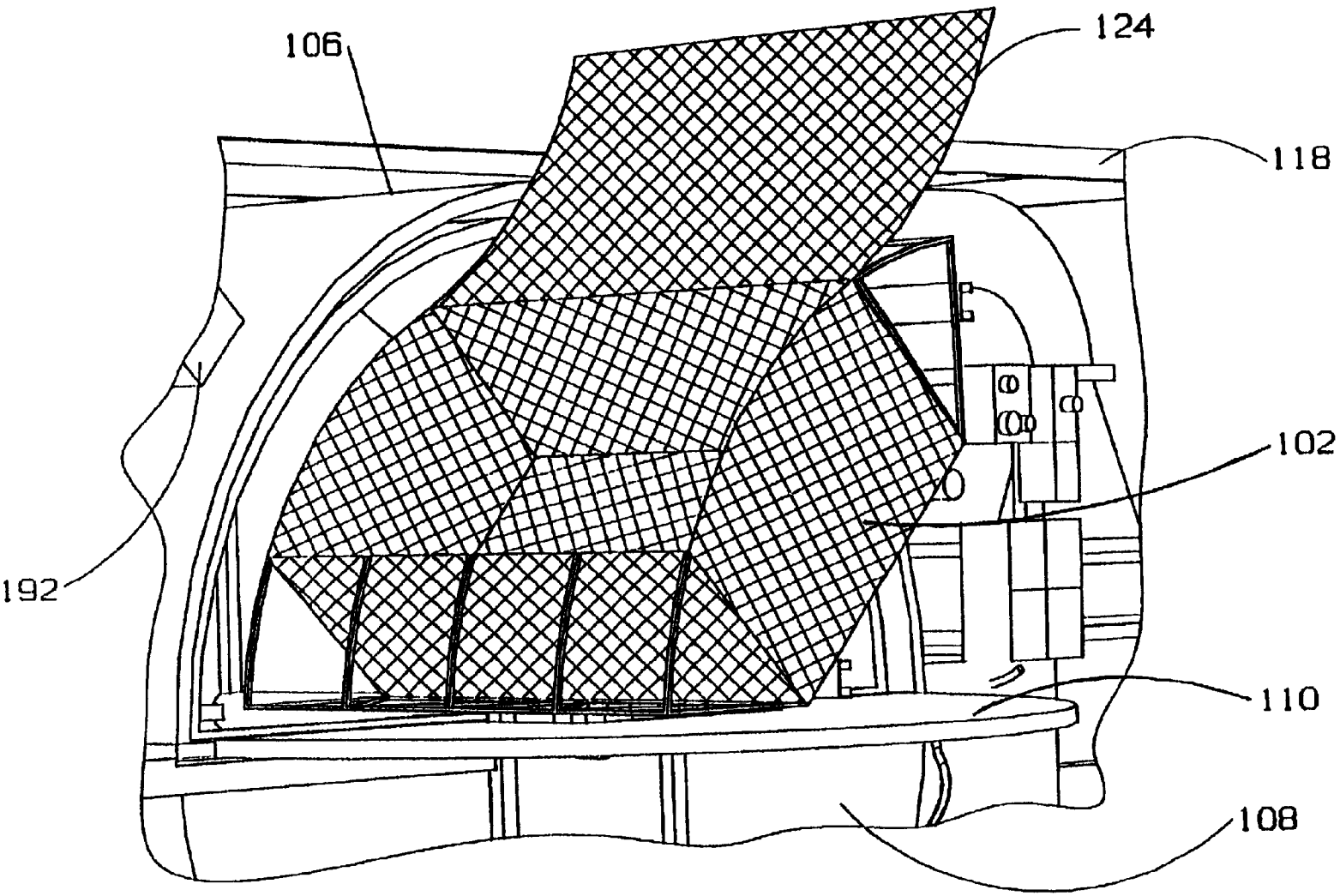
FIG. 18 is an enlarged view of the basket of FIG. 17 with the basket lid open.
Figure 19:
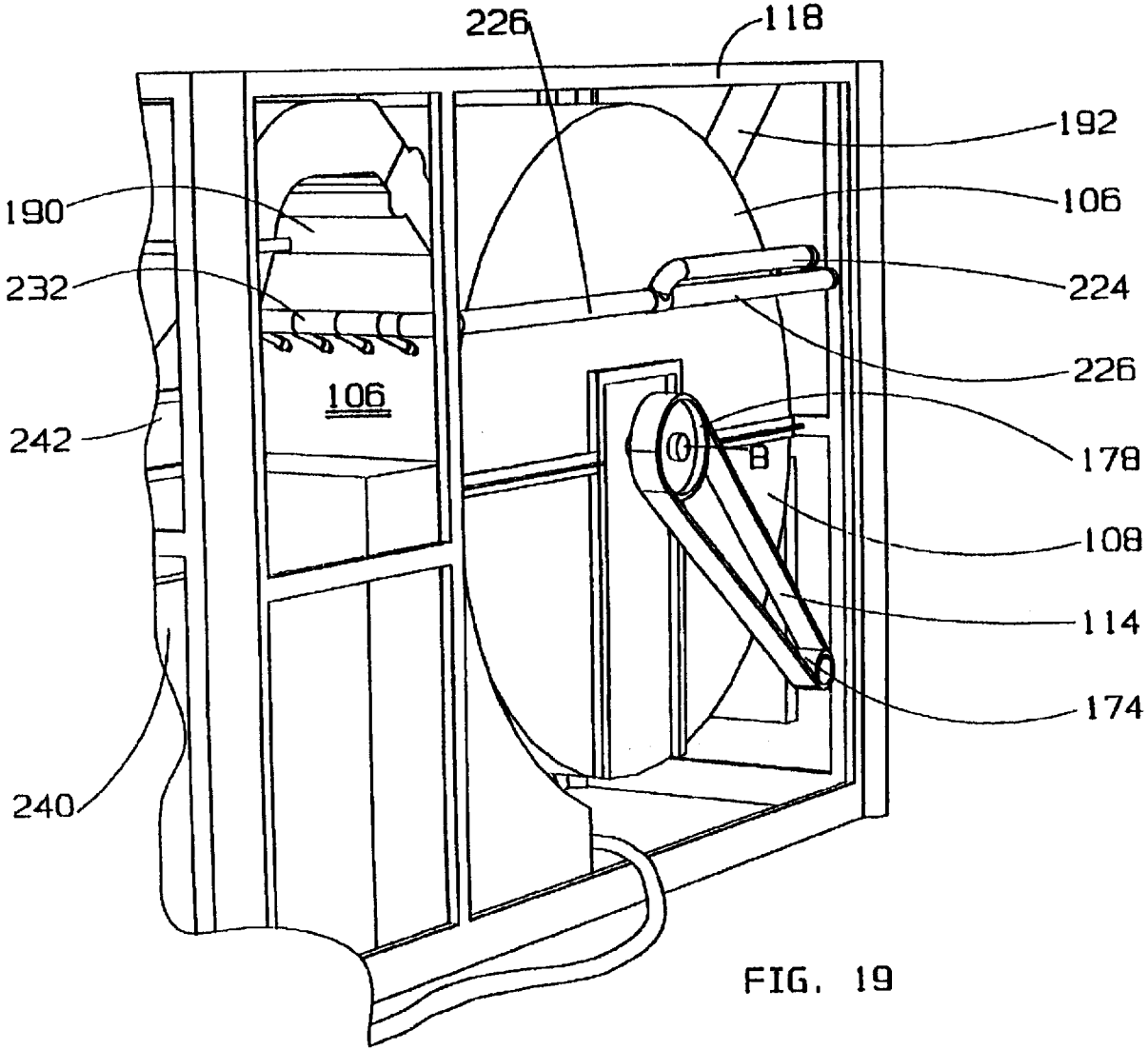
FIG. 19 is, in right rear perspective view, the machine of FIG. 15.
Figure 20:
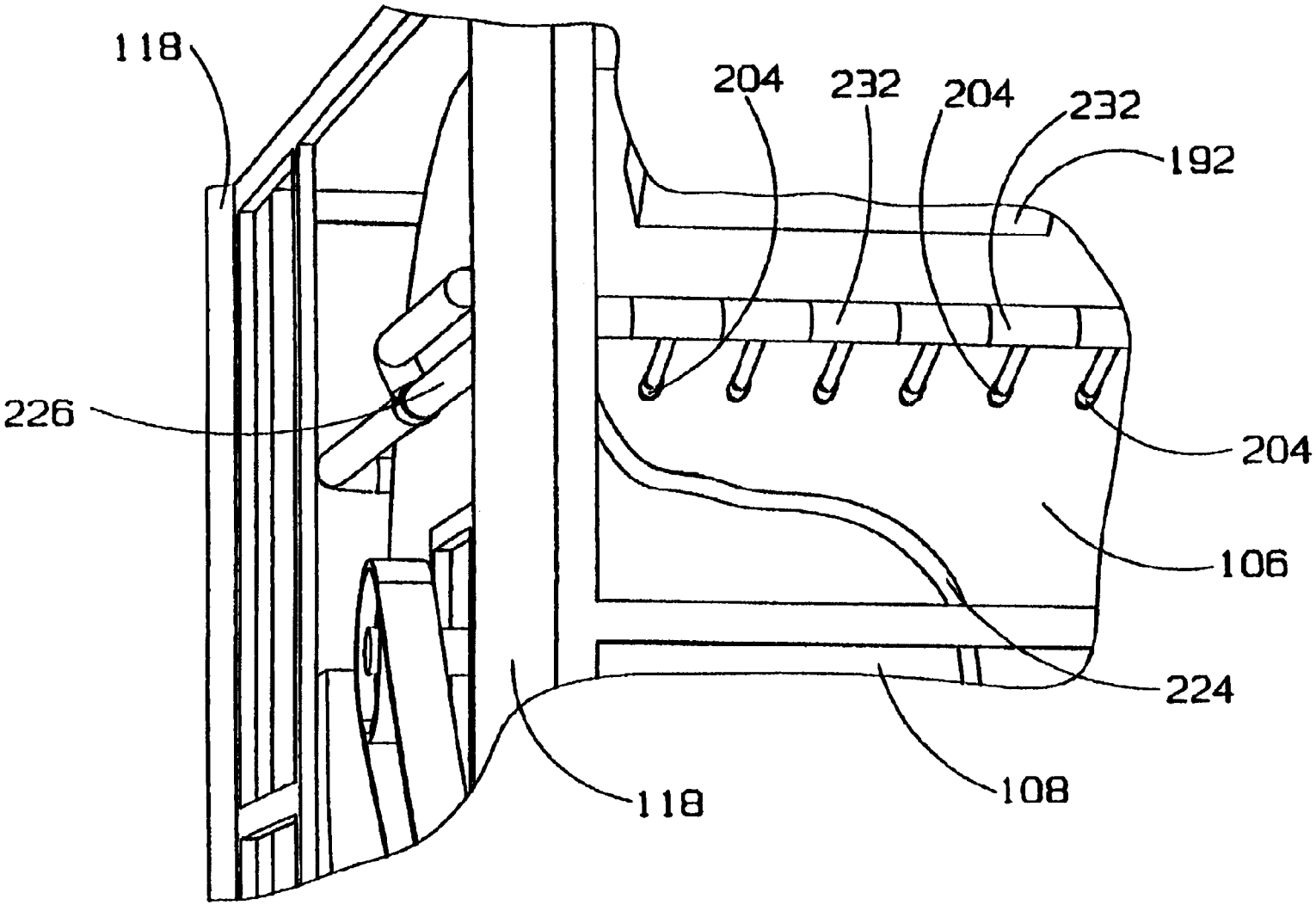
FIG. 20 is an enlarged view in left rear perspective view of the upper tub and spray nozzles of the machine of FIG. 15.

As seen in FIG. 15, baskets 102 telescope outwardly from cage 104 by means of sliders 130*a* telescopically sliding along telescopic members 240. In the preferred embodiment, telescopic members 240 are oblong blocks of ultra-high molecular weight (UHMW) polyethylene slidably mounted along one side thereof to sliders 130*a* on baskets 102 and slidably mounted on their opposite sides to slider angle brackets 140. Sliders 130*b* slidably engage slider plates 144.

It will be recognized by those skilled in the art that the washing and drying machine of the present invention is not to be restricted to sporting equipment which in the past has been difficult if not impossible to clean such as helmets, body armour, ski boots with or without the liner removed, but also applies to many other articles that are generally difficult if not impossible to clean without having to be washed by hand. Thus, for example the machine of the present invention may be applied to the washing of fire-fighter suits, flight suits, tents, equestrian equipment, bulky fabrics, backpacks, cloth carriers for bullet-proof vests, military and army body armour, harnesses used for lifting the disabled and elderly from beds or wheelchairs, and includes generally any other article which requires the use of an abundance of hook and loop fasteners which if placed in a conventional washing machine would become balled or knotted due to tumbling or which during a spin drying cycle may compact centrifugally radially outwards against the radially outer wall of the basket (radially outer relative to axis of rotation B) and so not dry properly.

Agitation by conventional agitators it has been found in many articles causes damage to the articles. Such includes the padding coming out of sports equipment, or the fabric becoming entangled and jammed and the agitator wears on the material or tears the fabric. Further, such articles make an easily unbalanced load during the spin cycle.

It would be recognized then that many soft or flexible articles may be placed into the baskets of the present invention, whether or not the articles are contained within a mesh bag as taught or the like, and once so held within the baskets, so as to be held relatively stationary relative to the cage, are rotated within the tub in contra-distinction to merely being placed into a tub and agitated.

Figure 21:
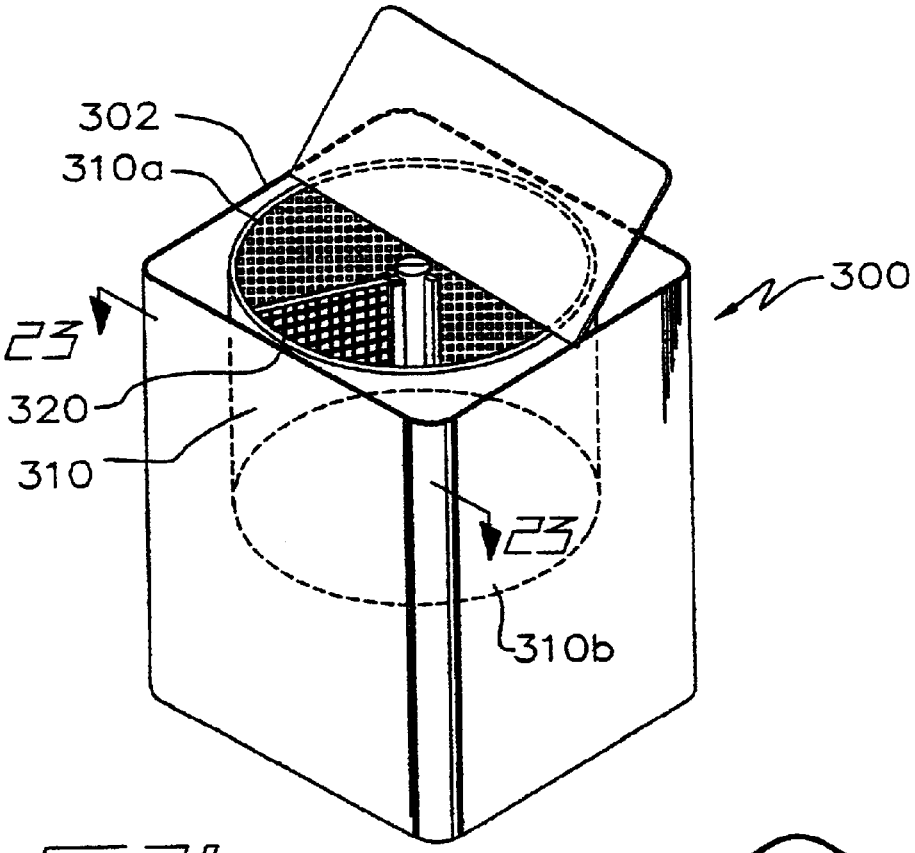
FIG. 21, is an isometric view of one form of top loading washer containing a drum having removable baffles.
Figure 22:
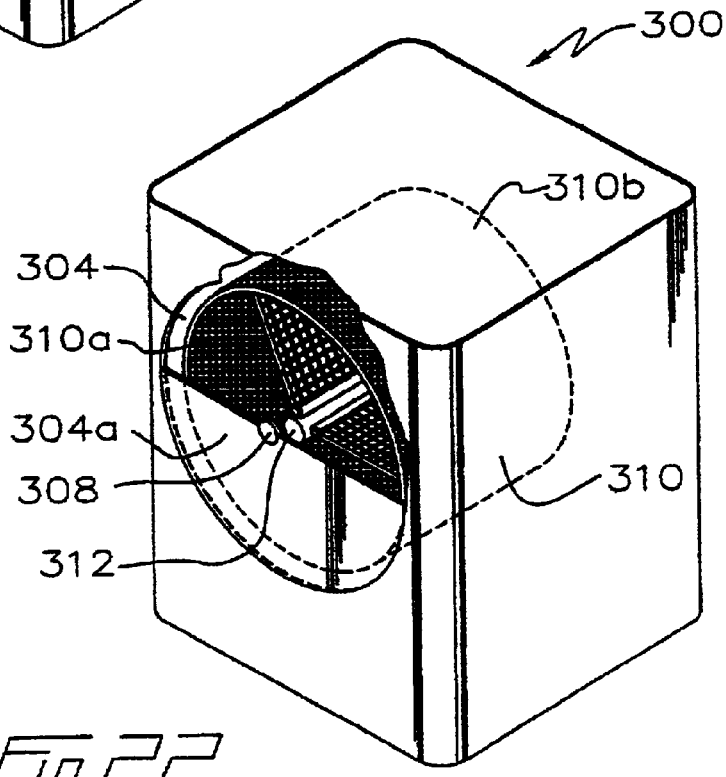
FIG. 22 is an isometric view of one form of side loading washer containing a drum having removable baffles.
Figure 23:
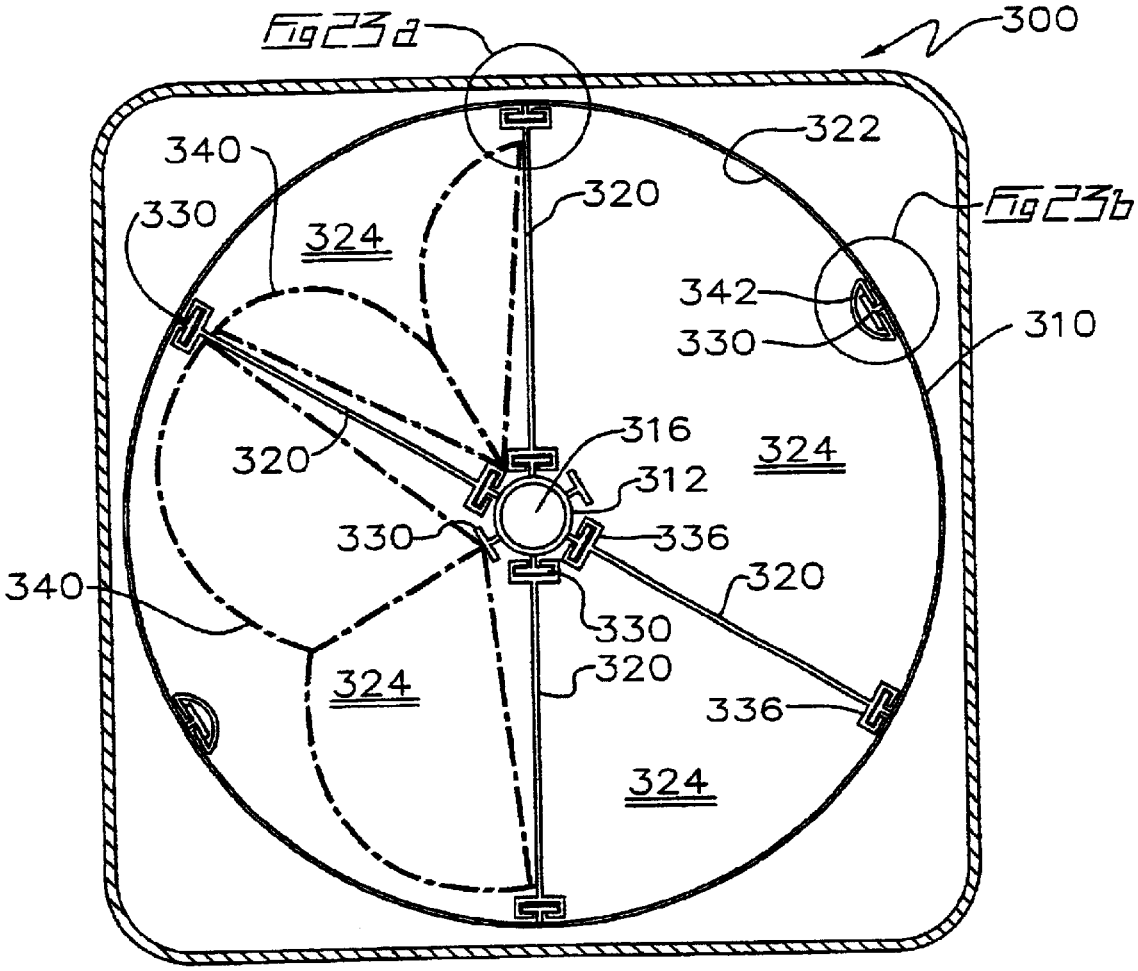
FIG. 23 is a sectional view taken on line 23—23 of FIG. 21.

In a further embodiment, and with reference to the FIGS. 21 and 22, a washer 300 is schematically depicted as either having a top loading access aperture or a side loading access aperture numerically identified as 302 and 304 respectively. Side loading access aperture 304 may be suitably sealed by a door, for example a door having a segment 304*a* generally containing 180 degrees of arc which may be arcuately rotatably slid about a central pivot 308 to effect opening or closure. Housed within washer 300 is a cylindrically shaped water porous basket or basket 310, which is open at its proximal end 310*a*, adjacent the loading access apertures 302 and 304 respectively and closed at its distal end 310*b*. As seen in FIG. 23, an elongated supporting sleeve 312 is mounted axially within basket 310 and secured to end 310*b*. This permits basket 310 to be mounted over drive axle 316 for rotation therewith about its axis of rotation.

One or more removable compartmentalizing walls or baffles 320, radially extending from supporting sleeve 312 to the inside face 322 of basket 310, that is radially outermost from the axis of rotation of the basket, create separate compartments 324 within basket 310. These baffles 320 generally extend the full depth of the basket 310 and may be manufactured from stainless steel rods or screens or otherwise so as to be water pervious, that is porous, but retentive of items for washing placed into compartments 324.

Figure 23A:
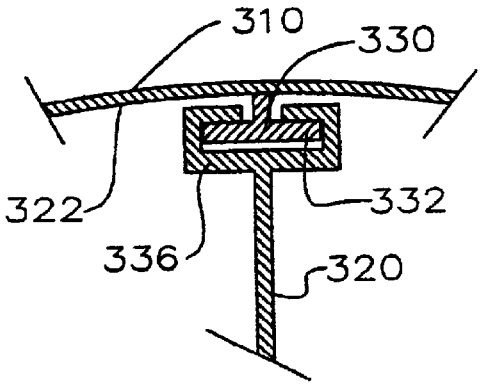
FIG. 23*a* is an enlarged portion of the baffle connector illustrated on FIG. 23.
Figure 24:
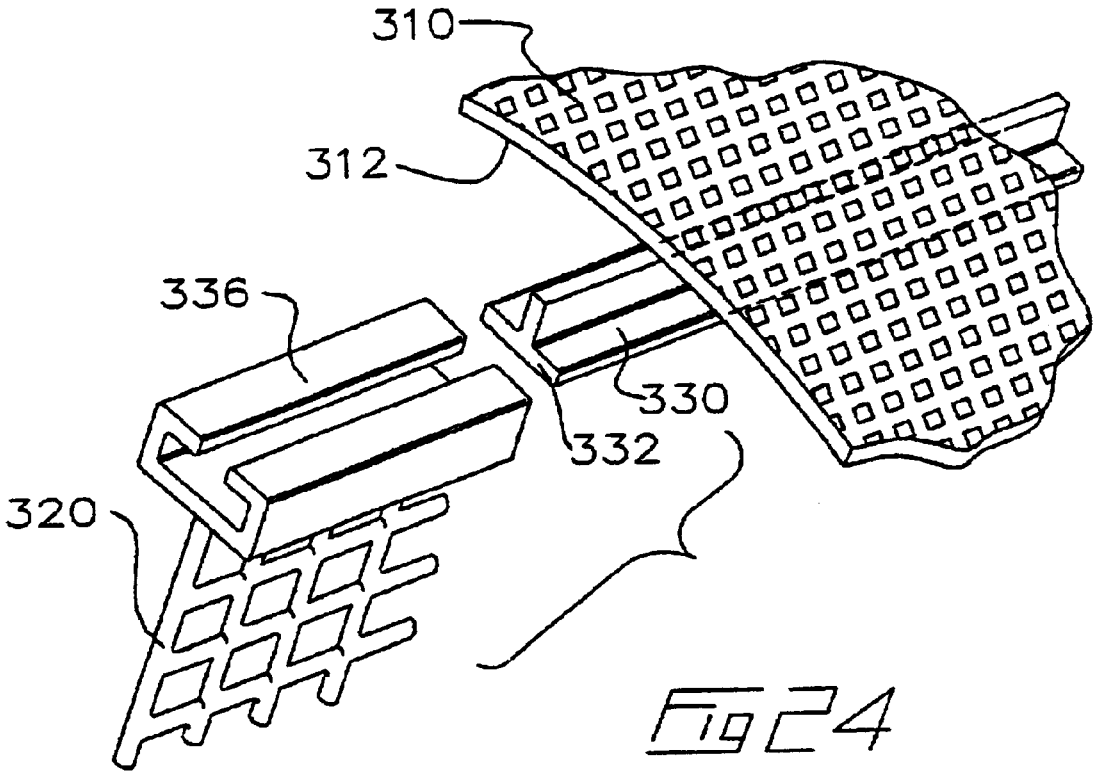
FIG. 24 is an enlarged isometric view of a baffle and connector.

FIGS. 23 and 24 illustrate one manner in which baffles 320 may be readily removable. Elongate mounting strips 330 are secured, as by welding or the like, to the sleeve 312 and inside face 322 of basket 310. Strips 330 may be in radially-spaced array around inside face 322 and sleeve 312, for example aligned in opposed facing pairs. Strips 330 may be tee-shaped in cross section so as to form cross-flange 332 spaced outwardly from the adjacent surfaces of the basket 310 and supporting sleeve 312. As seen in detail in FIG. 23*a* and FIG. 24, a pair of open channels 336 are formed on opposite edges of baffles 320. Channels 336 slidably engage tee-shaped mounting strips 330. Thus, baffles 320 may be installed onto or removed from strips 330 through the loading access aperture. Equipment containers such as garment bags 340 may be placed within a selected compartment in either the folded or opened position depending upon the size of the compartment as defined by baffles 320 installed into basket 310.

Depending upon the diameter of basket 310, a sufficient plurality of radially spaced mounting strips 330 are mounted around inside face 322 so as to permit adjacent baffles to include an included angle of for example 60 degrees about sleeve 312. This allows flexibility for adjusting the size of compartments within the interior of basket 310.

Figure 23B:
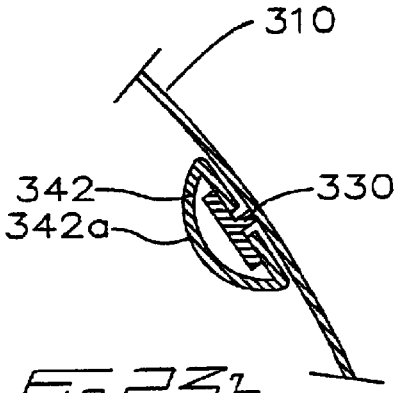
FIG. 23*b* is an enlarged portion of the lift shown on FIG. 23.

As seen in FIG. 23*b*, instead of a baffle, an elongate lift 342 may be slid over exposed strips 330. Although illustrated as hollow and hemispherical in cross-section, such lifts 342 may have any number of profiles in cross-section so as to more or less intrude into the basket to impart a desired turbulence or lifting agitation to the cleaning solution (or items within a compartment when it is desired to wash conventional apparel etc. where tumbling is appropriate) as the drum is rotated through the cleaning solution by drive axle 316. Lifts 342 are illustrated as having smoothly rounded profiles on their exposed faces 342*a*, which will impart only mild lifting agitation.

Figure 25:
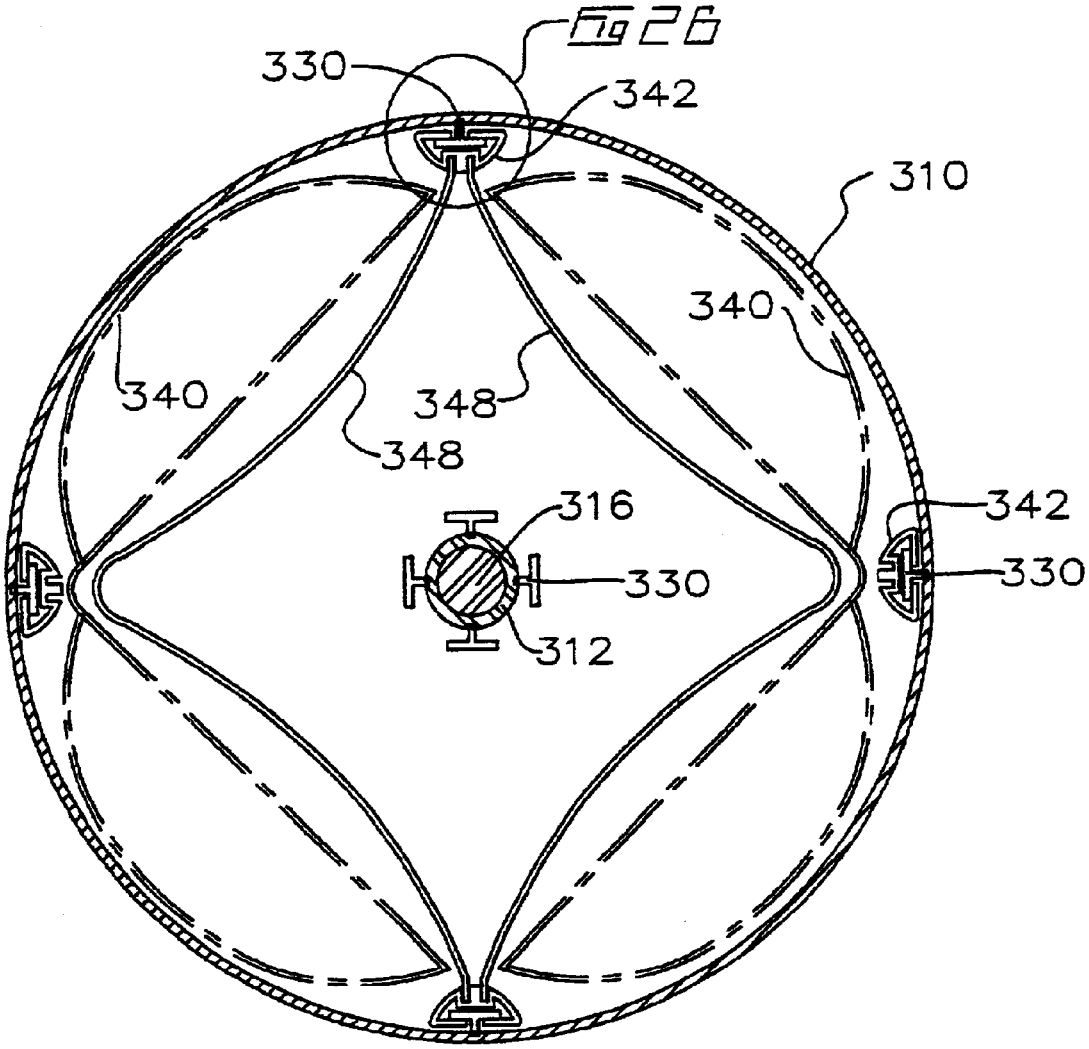
FIG. 25 is an alternative form of baffle.
Figure 26:
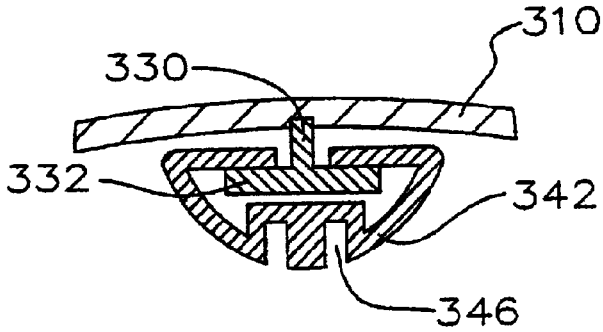
FIG. 26 is an enlarged portion of the lift shown on FIG. 25.

With reference to FIG. 25, basket 310 has been modified to removably secure only two equipment containers such as garment bags 340 in their open position. This is useful if the equipment containers are very large (for very large items), or if the diameter of basket 310 is relatively small. In this embodiment the lifts have formed in their exposed faces one or more notches 346. When lift 342 is slidably mounted on to strips 330, notches 346 extend generally radially inwardly toward sleeve 312. By placing lifts 340 over diametrically opposed strips 330, the ends of a resilient "V" shaped baffle 348 may be inserted into notches 346. Baffle 348 may have to be resiliently compressed or bent, the resulting outward force holding the edges of the baffles in their corresponding notches. When a garment bag 340 is inserted into a compartment defined by this "V" shaped baffle the bag is securely held in an open position. Again, such baffles generally extend the depth of basket 310 so that garment bags 340 are kept securely in place as the basket 310 is rotated through the cleaning solution.

As will be apparent to those skilled in the art in the light of the foregoing disclosures, many alterations and modifications are possible in the practice of this invention without departing from the spirit or scope thereof. The scope of the invention is to be construed in accordance with the substance defined by the following claims.

What is claimed is:

1. A device for washing flexible articles of apparel comprising;

a housing, a tub rigidly mounted to said housing, a basket rotatably mounted inside said tub for rotation of said basket about an axis of rotation, a basket rotation means mounted to said basket and actuable to rotate said basket during washing, rinsing and spin-drying cycles, a water supply and draining means cooperating with said tub for washing and rinsing said articles of apparel held in said basket, wherein said basket is an open-lattice sided container having removable compartmentalizing walls forming first compartments within said basket a releasably closable door and wherein said basket is, by means for securing said articles in said basket, adapted for both holding said articles of apparel substantially stationary relative to said basket and separated in said basket during said washing and rinsing cycles and during centrifugal spin-drying cycle, and for allowing penetration of water from said water supply throughout said articles of apparel as said basket is rotated relative to said tub, wherein said means for securing said flexible articles in each basket includes an equipment container having separate second compartments, said equipment container mountable into said first compartments in said basket for holding said articles of apparel generally individually separated from each other during said washing, rinsing and spin-drying cycles, and wherein during said centrifugal spin-drying of said articles of apparel during said spin-drying cycle, said basket is rotatable within said tub about said axis of rotation at a rotational speed sufficient to centrifugally force water from said articles.

2. The device of claim 1 wherein said equipment container is a mesh bag for holding said apparel, said mesh bag removably securable within said basket.

3. The device of claim 2 wherein said mesh bag is compartmentalized for simultaneously holding in spaced apart array various articles of said articles of apparel in said mesh bags when held in said basket.

* * * * *